US007917369B2

(12) United States Patent
Chen et al.

(10) Patent No.: US 7,917,369 B2
(45) Date of Patent: Mar. 29, 2011

(54) QUALITY IMPROVEMENT TECHNIQUES IN AN AUDIO ENCODER

(75) Inventors: Wei-Ge Chen, Sammamish, WA (US); Naveen Thumpudi, Sammamish, WA (US); Ming-Chieh Lee, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 11/737,072

(22) Filed: Apr. 18, 2007

(65) Prior Publication Data

US 2007/0185706 A1 Aug. 9, 2007

Related U.S. Application Data

(63) Continuation of application No. 10/016,918, filed on Dec. 14, 2001, now Pat. No. 7,240,001.

(51) Int. Cl.
*G10L 19/00* (2006.01)
*G10L 19/10* (2006.01)

(52) U.S. Cl. ..... 704/500; 704/501; 704/503; 704/504; 704/200.1; 704/230; 704/E19.005; 704/E19.015

(58) Field of Classification Search ..... 704/500, 704/503, 200.1, 230, E19.005, E19.015
See application file for complete search history.

(56) References Cited

U.S. PATENT DOCUMENTS 4,251,688 A 2/1981 Furner
4,538,234 A * 8/1985 Honda et al. ..... 704/229
4,953,196 A * 8/1990 Ishikawa et al. ..... 348/14.14
5,079,547 A 1/1992 Fuchigama et al.
5,260,980 A 11/1993 Akagiri et al.
5,388,181 A 2/1995 Anderson et al.
5,455,888 A 10/1995 Iyengar et al.
5,473,727 A 12/1995 Nishiguchi et al.
5,524,054 A 6/1996 Spille (Continued)

FOREIGN PATENT DOCUMENTS

EP 0597649 5/1994

(Continued)

OTHER PUBLICATIONS

Geiger et al., "Audio Coding Based on Integer Transforms," AES Convention Paper 5471, 111th AES Convention, New York, NY, Sep. 21-24, 2001.

(Continued)

*Primary Examiner* — James S Wozniak
*Assistant Examiner* — Abdelali Serrou
(74) *Attorney, Agent, or Firm* — Klarquist Sparkman, LLP

(57) ABSTRACT

An audio encoder implements multi-channel coding decision, band truncation, multi-channel rematrixing, and header reduction techniques to improve quality and coding efficiency. In the multi-channel coding decision technique, the audio encoder dynamically selects between joint and independent coding of a multi-channel audio signal via an open-loop decision based upon (a) energy separation between the coding channels, and (b) the disparity between excitation patterns of the separate input channels. In the band truncation technique, the audio encoder performs open-loop band truncation at a cut-off frequency based on a target perceptual quality measure. In multi-channel rematrixing technique, the audio encoder suppresses certain coefficients of a difference channel by scaling according to a scale factor, which is based on current average levels of perceptual quality, current rate control buffer fullness, coding mode, and the amount of channel separation in the source. In the header reduction technique, the audio encoder selectively modifies the quantization step size of zeroed quantization bands so as to encode in fewer frame header bits.

5 Claims, 16 Drawing Sheets

U.S. PATENT DOCUMENTS 5,539,829 A 7/1996 Lokhoff et al.
5,581,653 A 12/1996 Todd
5,627,938 A 5/1997 Johnston
5,629,780 A 5/1997 Watson
5,632,003 A * 5/1997 Davidson et al. ..... 704/200.1
5,636,324 A 6/1997 Teh et al.
5,661,755 A 8/1997 Van De Kerkhof et al.
5,661,823 A 8/1997 Yamauchi et al.
5,682,152 A 10/1997 Wang et al.
5,684,920 A 11/1997 Iwakami et al.
5,686,964 A 11/1997 Tabatabai et al.
5,701,346 A 12/1997 Herre et al.
5,745,275 A 4/1998 Giles et al.
5,787,390 A 7/1998 Quinquis et al.
5,812,971 A 9/1998 Herre
5,822,370 A 10/1998 Graupe
5,826,221 A 10/1998 Aoyagi
5,835,030 A 11/1998 Tsutsui et al.
5,845,243 A 12/1998 Smart et al.
5,890,108 A 3/1999 Yeldener
5,956,674 A 9/1999 Smyth et al.
5,969,750 A * 10/1999 Hsieh et al. ..... 348/14.1
5,973,629 A * 10/1999 Fujii ..... 341/76
5,974,380 A 10/1999 Smyth et al.
5,995,151 A 11/1999 Naveen et al.
6,016,111 A * 1/2000 Park et al. ..... 341/55
6,029,126 A 2/2000 Malvar
6,041,295 A 3/2000 Hinderks
RE36,721 E 5/2000 Akamine et al.
6,058,362 A 5/2000 Malvar
6,064,954 A 5/2000 Cohen et al.
6,104,321 A 8/2000 Akagiri
6,104,996 A 8/2000 Yin
6,115,688 A 9/2000 Brandenburg et al.
6,115,689 A * 9/2000 Malvar ..... 704/503
6,134,523 A * 10/2000 Nakajima et al. ..... 704/229
6,167,373 A 12/2000 Morii
6,182,034 B1 1/2001 Malvar
6,185,253 B1 * 2/2001 Pauls ..... 375/240.02
6,205,430 B1 3/2001 Hui
6,212,495 B1 * 4/2001 Chihara ..... 704/221
6,226,616 B1 5/2001 You
6,240,380 B1 5/2001 Malvar
6,249,614 B1 6/2001 Kolesnik et al.
6,253,185 B1 * 6/2001 Arean et al. ..... 704/500
6,256,608 B1 7/2001 Malvar
6,341,165 B1 1/2002 Gbur et al.
6,353,807 B1 3/2002 Tsutsui et al.
6,366,881 B1 * 4/2002 Inoue ..... 704/230
6,370,128 B1 4/2002 Raitola
6,370,502 B1 4/2002 Wu et al.
6,393,392 B1 5/2002 Minde
6,404,827 B1 6/2002 Uesugi
6,418,405 B1 7/2002 Satyamurti et al.
6,424,939 B1 7/2002 Herre et al.
6,434,190 B1 8/2002 Modlin
6,445,739 B1 9/2002 Shen et al.
6,473,561 B1 10/2002 Heo
6,496,798 B1 12/2002 Huang et al.
6,499,010 B1 * 12/2002 Faller ..... 704/229
6,594,626 B2 7/2003 Suzuki et al.
6,658,162 B1 12/2003 Zeng et al.
6,680,972 B1 1/2004 Liljeryd
6,697,491 B1 2/2004 Griesinger
6,704,711 B2 3/2004 Gustafsson et al.
6,738,074 B2 5/2004 Rao et al.
6,757,654 B1 6/2004 Westerlund et al.
6,760,698 B2 7/2004 Gao
6,766,293 B1 7/2004 Herre et al.
6,771,777 B1 8/2004 Gbur et al.
6,774,820 B2 8/2004 Craven et al.
6,807,524 B1 10/2004 Bessette et al.
6,836,761 B1 12/2004 Kawashima et al.
6,865,534 B1 3/2005 Murashima et al.
6,934,677 B2 8/2005 Chen et al.
6,940,840 B2 9/2005 Ozluturk et al.
7,027,982 B2 4/2006 Chen
7,050,972 B2 5/2006 Henn et al.
7,058,571 B2 6/2006 Tsushima et al.
7,062,445 B2 6/2006 Kadatch
7,069,212 B2 6/2006 Tanaka et al.
7,096,240 B1 * 8/2006 Absar et al. ..... 708/203
7,249,016 B2 7/2007 Chen et al.
7,269,559 B2 9/2007 Kondo et al.
7,328,162 B2 2/2008 Liljeryd et al.
7,386,132 B2 6/2008 Griesinger
7,394,903 B2 7/2008 Herre et al.
7,460,993 B2 12/2008 Chen et al.
7,519,538 B2 4/2009 Villemoes et al.
7,602,922 B2 10/2009 Breebaart et al.
2002/0143556 A1 10/2002 Kadatch
2003/0009327 A1 1/2003 Nilsson et al.
2003/0050786 A1 3/2003 Jax et al.
2003/0115042 A1 6/2003 Chen et al.
2003/0115052 A1 6/2003 Chen et al.
2003/0236580 A1 12/2003 Wilson et al.
2004/0001608 A1 1/2004 Rhoads
2004/0044527 A1 3/2004 Thumpudi et al.
2004/0078194 A1 4/2004 Liljeryd et al.
2004/0093208 A1 5/2004 Yin
2004/0267543 A1 12/2004 Ojanpera
2005/0065780 A1 3/2005 Wiser et al.
2005/0165611 A1 7/2005 Mehrotra et al.
2005/0246164 A1 11/2005 Ojala et al.
2006/0013405 A1 1/2006 Oh
2006/0106619 A1 5/2006 Iser et al.
2006/0259303 A1 11/2006 Bakis
2007/0081536 A1 4/2007 Kim et al.
2007/0112559 A1 5/2007 Schuijers et al.
2007/0140499 A1 6/2007 Davis
2007/0172071 A1 7/2007 Mehrotra et al.

FOREIGN PATENT DOCUMENTS

EP 0663740 7/1995
EP 0669724 8/1995
EP 0910927 4/1999
EP 0 924 962 6/1999
EP 0931386 7/1999
EP 1093113 4/2001
EP 1175030 1/2002
EP 1408484 4/2004
EP 1617418 1/2006
GB 2318029 4/1998
JP 6-75590 3/1994
JP 6-149292 5/1994
JP 2001-44844 2/2001
JP 2001-285073 10/2001
JP 2002-526798 8/2002
WO WO 88/01811 3/1988
WO WO 95/02925 1/1995
WO WO 95/02930 1/1995
WO WO 99/43110 8/1999
WO WO 00/02357 1/2000
WO WO 00/60746 10/2000
WO 02/43054 5/2002
WO WO 2005/098821 10/2005

OTHER PUBLICATIONS

"Method for Objective Measurements of Perceived Audio Quality," *Rec. ITU-R BS.1387* (Question ITU-R 210/10), 1998.

Gibson et al., *Digital Compression for Multimedia*, Title Page, Contents, "Chapter 7: Frequency Domain Coding," Morgan Kaufman Publishers, Inc., pp. iii, v-xi, and 227-262 (1998).

H.S. Malvar, "Signal Processing with Lapped Transforms," Artech House, Norwood, MA, pp. iv, vii-xi, 175-218, 353-357 (1992).

H.S. Malvar, "Lapped Transforms for Efficient Transform/Subband Coding," *IEEE Transactions on Acoustics, Speech and Signal Processing*, vol. 38, No. 6, pp. 969-978 (1990).

Seymour Schlien, "The Modulated Lapped Transform, Its Time-Varying Forms, and Its Application to Audio Coding Standards," *IEEE Transactions on Speech and Audio Processing*, vol. 5, No. 4, pp. 359-366 (Jul. 1997).

de Queiroz et al., "Time-Varying Lapped Transforms and Wavelet Packets," *IEEE Transactions on Signal Processing*, vol. 41, pp. 3293-3305 (1993).

Herley et al., "Tilings of the Time-Frequency Plane: Construction of Arbitrary Orthogonal Bases and Fast Tiling Algorithms," *IEEE Transactions on Signal Processing*, vol. 41, No. 12, pp. 3341-3359 (1993).
ISO/IEC 11172-3, Information Technology—Coding of Moving Pictures and Associated Audio for Digital Storage Media at Up to About 1.5 Mbit/s—Part 3: Audio, 154 pp. (1993).
Dolby Laboratories, "AAC Technology," 4 pp. [Downloaded from the web site aac-audio.com on World Wide Web on Nov. 21, 2001.].
Srinivasan et al., "High-Quality Audio Compression Using an Adaptive Wavelet Packet Decomposition and Psychoacoustic Modeling," *IEEE Transactions on Signal Processing*, vol. 46, No. 4, pp. 1085-1093 (Apr. 1998).
Caetano et al., "Rate Control Strategy for Embedded Wavelet Video Coders," *Electronics Letters*, pp. 1815-1817 (Oct. 14, 1999).
Ribas Corbera et al., "Rate Control in DCT Video Coding for Low-Delay Communications," *IEEE Transactions on Circuits and Systems for Video Technology*, vol. 9, No. 1, pp. 172-185 (Feb. 1999).
Zwicker et al., *Das Ohr als Nachrichtenempfänger*, Title Page, Table of Contents, "I: Schallschwingungen," Index, Hirzel-Verlag, Stuttgart, pp. III, IX-XI, 1-26, and 231-232 (1967).
Terhardt, "Calculating Virtual Pitch," *Hearing Research*, 1:155-182 (1979).
Lufti, "Additivity of Simultaneous Masking," *Journal of Acoustic Society of America*, 73:262-267 (1983).
Jesteadt et al., "Forward Masking as a Function of Frequency, Masker Level, and Signal Delay," *Journal of Acoustical Society of America*, 71:950-962 (1982).
ITU, Recommendation ITU-R BS 1387, Method for Objective Measurements of Perceived Audio Quality, 89 pp. (1998).
ITU, Recommendation ITU-R BS 1115, Low Bit-Rate Audio Coding, 9 pp. (1994).
Beerends, "Audio Quality Determination Based on Perceptual Measurement Techniques," *Applications of Digital Signal Processing to Audio and Acoustics*, Chapter 1, Ed. Mark Kahrs, Karlheinz Brandenburg, Kluwer Acad. Publ., pp. 1-38 (1998).
Zwicker, *Psychoakustik*, Title Page, Table of Contents, "Teil I: Einfuhrung," Index, Springer-Verlag, Berlin Heidelberg, New York, pp. II, IX-XI, 1-30, and 157-162 (1982).
Solari, *Digital Video and Audio Compression*, Title Page, Contents, "Chapter 8: Sound and Audio," McGraw-Hill, Inc., pp. iii, v-vi, and 187-211 (1997).
A.M. Kondoz, *Digital Speech: Coding for Low Bit Rate Communications Systems*, "Chapter 3.3: Linear Predictive Modeling of Speech Signals" and "Chapter 4: LPC Parameter Quantisation Using LSFs," John Wiley & Sons, pp. 42-53 and 79-97 (1994).
Kadatch, U.S. Appl. No. 09/771,371, entitled, "Quantization Loop with Heuristic Approach," filed Jan. 26, 2001.
Chen et al., U.S. Appl. No. 10/017,694, entitled, "Quality and Rate Control Strategy for Digital Audio," filed Dec. 14, 2001.
Chen et al., U.S. Appl. No. 10/017,702, entitled, "Quantization Matrices for Digital Audio," filed Dec. 14, 2001.
Chen et al., U.S. Appl. No. 10/017,861, entitled, "Techniques for Measurement of Perceptual Audio Quality," filed Dec. 14, 2001.
Chen et al., U.S. Appl. No. 10/020,708, entitled, "Adaptive Window-Size Selection in Transform Coding," filed Dec. 14, 2001.
Wragg et al., "An Optimised Software Solution for an ARM Powered™ MP3 Decoder," 9 pp. [Downloaded from the World Wide Web on Oct. 27, 2001.].
Fraunhofer-Gesellschaft, "MPEG Audio Layer-3," 4 pp. [Downloaded from the World Wide Web on Oct. 24, 2001.].
Fraunhofer-Gesellschaft, "MPEG-2 AAC," 3 pp. [Downloaded from the World Wide Web on Oct. 24, 2001.].
OPTICOM GmbH, "Objective Perceptual Measurement," 14 pp. [Downloaded from the World Wide Web on Oct. 24, 2001.].
De Luca, "AN1090 Application Note: STA013 MPEG 2.5 Layer III Source Decoder," STMicroelectronics, 17 pp. (1999).
Phamdo, "Speech Compression," 13 pp. [Downloaded from the World Wide Web on Nov. 25, 2001.].
Malvar, "Biorthogonal and Nonuniform Lapped Transforms for Transform Coding with Reduced Blocking and Ringing Artifacts," appeared in *IEEE Transactions on Signal Processing, Special Issue on Multirate Systems, Filter Banks, Wavelets, and Applications*, vol. 46, 29 pp. (1998).
Advanced Television Systems Committee, *ATSC Standard: Digital Audio Compression (AC-3), Revision A*, 140 pp. (1995).
Brandenburg, "ASPEC Coding", *AES 10th International Conference*, pp. 81-90 (1991).
"ISO/IEC 11172-3, Information Technology—Coding of Moving Pictures and Associated Audio for Digital Storage Media at Up to About 1.5 Mbit/s—Part 3: Audio," 154 pp. (1993).
"ISO/IEC 13818-7, Information Technology—Generic Coding of Moving Pictures and Associated Audio Information—Part 7: Advanced Audio Coding (AAC)," 174 pp. (1997).
"ISO/IEC 13818-7, Information Technology—Generic Coding of Moving Pictures and Associated Audio Information—Part 7: Advanced Audio Coding (AAC), Technical Corrigendum 1" 22 pp. (1998).
Lutfi, "Additivity of Simultaneous Masking," *Journal of Acoustic Society of America*, 73:262-267 (1983).
Hasegawa-Johnson et al., "Speech coding: fundamentals and applications," *Handbook of Telecommunications*, John Wiley and Sons, Inc., pp. 1-33 (2003). [available at http://citeseer.ist.psu.edu/617093.html].
Najafzadeh-Azghandi et al., "Perceptual coding of narrowband audio signals at 8 Kbit/s" (1997), available at http://citeseer.ist.psu.edu/najafzadeh-azghandi97perceptual.html.
Painter et al., "Perceptual Coding Of Digital Audio," *Proceedings Of The IEEE*, vol. 88, Issue 4, pp. 451-515, Apr. 2000, available at http://www.eas.asu.edu/~spanias/papers/paper-audio-tedspanias-00.pdf.
Schroeder et al., "Code-excited linear prediction (CELP): High-quality speech at very low bit rates," *Proc. IEEE Int. Conf ASSP*, pp. 937-940, 1985.
Schulz, "Improving audio codecs by noise substitution," *Journal Of The AES*, vol. 44, No. 7/8, pp. 593-598, Jul./Aug. 1996.
Sporer et al., "The Use of Multirate Filter Banks for Coding of High Quality Digital Audio," *6th European Signal Processing Conference (EUSIPCO)*, Amsterdam, vol. 1, pp. 211-214, Jun. 1992.
Bier, "Digital Audio Compression: Why, What, and How," © 2000-2002 Berkeley Design Technology, Inc., Dec. 2, 2002, 15 pages.
Bosi et al., "ISO/IEC MPEG-2 Advanced Audio Coding," Journal of the Audio Engineering Society, Audio Engineering Society, vol. 45, No. 10, pp. 789-812 (1997).
Brandenburg, "MP3 and AAC Explained," AES 17th International Conference on High Quality Audio Coding, 1999, 12 pages.
Davis, "The AC-3 Multichannel Coder," Dolby Laboratories, 9 pp. (Downloaded from the World Wide Web on Aug. 15, 2002).
Edler et al., "Perceptual Audio Coding Using a Time-Varying Linear Pre- and Post-Filter," in AES 109th Convention, Los Angeles, California, 12 pp. (Sep. 2000).
Gibson et al., Digital Compression for Multimedia, Title Page, Contents, "Chapter 8: Frequency Domain Speech and Audio Coding Standards," Morgan Kaufman Publishers, Inc., pp. 263-290 (1998).
Gillespie et al., "Speech dereverberation via maximum-kurtosis subband adaptive filtering," Proc. IEEE ICASSP, 2001, pp. 3701-3704.
Herre, "From Joint Stereo to Spatial Audio Coding—Recent Progress and Standardization," Proc. Of the 7th Int. Conference on Digital Audio Effects (DAFx'04), 2004, pp. 157-162.
Herre et al., "Intensity Stereo Coding," presented at AES 96th Convention, 1994, 11 pages.
ISO/IEC 13818-7, Information technology—Generic coding of moving pictures and associated audio information—Part 7: Advanced Audio Coding (AAC), 150 pp. (1997).
Kuo et al., "A Study of Why Cross Channel Prediction is Not Applicable to Perceptual Audio Coding," IEEE Signal Processing Letters, vol. 8, No. 9, 3 pp. (Sep. 2001).
Meares, D.J., "Matrixed Surround Sound in an MPEG Digital World," Journal of the Audio Engineering Society, vol. 46, No. 4, 13 pp. (Apr. 1998).
"MPEG2 Audio for DVD: the Compromise Choice," 5 pp. (Oct. 1996).

Püschel et al., "The Algebraic Approach to the Discrete Cosine and Sine Transforms and their Fast Algorithms," SIAM Journal of Computing 2003, vol. 32, No. 5, pp. 1280-1316.
"Radio Engineering," authored by KPR i-Services, Inc., printed from internet on Dec. 13, 2005, 3 pages.
Schroeder, "'Colorless' Artificial Reverberation," presented at Audio Engineering Society 12th Annual Meeting, 1960, 18 pages.
Schroeder, "Natural Sounding Artificial Reverberation," presented at the Audio Engineering Society 13th Annual Meeting, 1961, 18 pages.
Search Report for European Patent Application No. 03 020 110.7.
Search Report for European Patent Application No. 03 020 111.5.
Search Report for PCT/US2004/024935.
"Smart Project—Algebraic Theorgy of Signal Processing," http://www.ece.cmu.edu/~smart/papers/dttaglo.html, printed from internet on Jun. 30, 2006, 2 pages.
Smith, "Physical Audio Signal Processing: for Virtual Musical Instruments and Digital Audio Effects," (Global Contents—13 pages, Allpass Filters—2 pages, Schroeder Allpass Sections—2 pages, and A Schroeder Reverberator called JCRev—2 pages) of online book at http://ccrma.stanford.edu/~jos/pasp/, Center for Computer Research in Music and Acoustics (CCRMA), Stanford University, printed from internet on Dec. 20, 2005, 19 pages.
Stuart et al., "Lossless Compression for DVD-Audio," in AES 9th Regional Convention Tokyo, 4 pp. (1999).
Vaidyanathan, Multirate Systems and Filter Banks, Prentice Hall Signal Processing Series, Cover page, pp. 745-751 (1992).
Van Assche et al., "Lossless Compression of Pre-Press Image Using a Novel Color Decorrelation Technique," Proc. SPIE, Very High Resolution and Quality III. vol. 3308, 8 pp. (1998).
Wang et al., "A Multichannel Audio Coding Algorithm for Inter-Channel Redundancy Removal," in AES 110th Convention, Amsterdam, the Netherlands, 6pp. (May 2001).
Wang et al., "EE225a Lecture 13: Karhunen Loève Transform and Discrete Cosine Transform," Department of EECS, University of California at Berkley, 10 pp. (Mar. 2002).
Yang et al., "Adaptive Karhunen-Loeve Transform for Enhanced Multichannel Audio Coding," Proc. SPIE vol. 4475, 13 pp., Mathematics of Data/Image Coding, Compression, and Encryption IV San Diego, CA. (Jul. 29-Aug. 3, 2001).
Yang et al., "An Inter-Channel Redundancy Removal Approach for High-Quality Multichannel Audio Compression," in AES 109th Convention, Los Angeles, California, 8 pp. (Sep. 2000).
Lopez et al., "Software Toolbox for Multichannel Sound Reproduction," Proceedings of Digital Audio Effects Conference (DAFX), Barcelona, Spain, Dec. 1998.
Dietz et al., "Spectral Band Replication, a novel approach in audio coding," Preprint 5553, 112th AES Convention, Munich, 8 pages, May 2002.
Ekstrand, "Bandwidth Extension of Audio Signals by Spectral Band Replication," Proc 1st EEE Benelux Workshop on Model based Processing and Coding of Audio, Leuven, Belgium, pp. 73-79, Nov. 2002.
Kornagel, "Techniques for artificial bandwidth extension of telephone speech," Signal Processing, vol. 86, No. 6, pp. 1296-1306, Oct. 2005.
Laaksonen, "Bandwidth extension in high-quality audio coding," Master's Thesis, 69 pp., May 30, 2005.
Najafzadeh-Azghandi et al., "Improving perceptual coding of narrowband audio signals at low rates," Acoustics, Speech, and Signal Processings, IEEE International Conference on Phoenix, AZ, vol. 2, pp. 913-916, Mar. 15, 1999.
Audio Codec Processing Functions; Extended AMR Wideband Codec; Transcoding Functions (Release 6), 3rd Generation Partnership Technical Specification, Sep. 2004, pp. 1-86.
Autti et al., "Mobile Audio—from MP3 to AAC and further," Helsinki University of Technology, Nov. 2004, pp. 1-20.
Breebaart et al., "Parametric Coding of Stereo Audio," EURASIP Jour. Applied Signal Proc., Sep. 2005, pp. 1305-1322.
Purnhagen, "Low Complexity Parametric Stereo Coding in MPEG-4," Proc. Of the 7th Int. Conference on Digital Audio Effects, Oct. 2004, pp. 163-168.
Schuijers et al., "Low Complexity Parametric Stereo Coding," 116th convention of the AES, May 2004, pp. 1-11.
Moriya et al., "Extension and Complexity Reduction of TWINVQ Audio Coder," IEEE ICASSP, pp. 1029-1032 (May 1996).
Soon et al., "Bandwidth Extension of Narrowband Speech Using Soft-decision Vector Quantization," ICICS 2005, pp. 734-738, Bangkok, Thailand (Dec. 2005).
Brandenburg, "ASPEC Coding", AES 10th International Conference, pp. 81-90 (Sep. 1991).
Brandenburg et al., "ASPEC: Adaptive Spectral Entropy Coding of High Quality Music Signals," Proc. AES, 12 pp. (Feb. 1991).
Brandenburg, "High Quality Sound Coding at 2.5 Bits/Sample," Proc. AES, 15 pp. (Mar. 1988).
Brandenburg, "OCF: Coding High Quality Audio with Data Rates of 64 kbit/sec," Proc. AES, 17 pp. (Mar. 1988).
Brandenburg et al., "Low Bit Rate Codecs for Audio Signals: Implementations in Real Time," Proc. AES, 12 pp. (Nov. 1988).
Brandenburg et al., "Low Bit Rate Coding of High-quality Digital Audio: Algorithms and Evaluation of Quality," Proc. AES, pp. 201-209 (May 1989).
Brandenburg, "OCF—A New Coding Algorithm for High Quality Sound Signals," Proc. ICASSP, pp. 5.1.1-5.1.4 (May 1987).
Brandenburg et al, "Second Generation Perceptual Audio Coding: the Hybrid Coder," AES Preprint, 13 pp. (Mar. 1990).
Breebaart et al., "MPEG Spatial Audio Coding/MPEG Surround: Overview and Current Status," in Proc. 119th AES Conv., New York, NY, Oct. 7-10, 2005, pp. 1-17.
Duhamel et al., "A Fast Algorithm for the Implementation of Filter Banks Based on Time Domain Aliasing Cancellation," Proc. Int'l Conf. Acous., Speech, and Sig. Process, pp. 2209-2212 (May 1991).
Herre et al., "The Reference Model Architecture for MPEG Spatial Audio Coding," Proc. 118th AES Convention, Barcelona, Spain, May 28-31, 2005, pp. 1-13.
Iwadare et al., "A 128 kb/s Hi-Fi Audio CODEC Based on Adaptive Transform Coding with Adaptive Block Size MDCT," IEEE. J. Sel. Areas in Comm., pp. 138-144 (Jan. 1992).
Johnston, "Perceptual Transform Coding of Wideband Stereo Signals," Proc. ICASSP, pp. 1993-1996 (May 1989).
Johnston, "Transform Coding of Audio Signals Using Perceptual Noise Criteria," IEEE J. Sel. Areas in Comm., pp. 314-323 (Feb. 1988).
Mahieux et al., "Transform Coding of Audio Signals at 64 kbits/sec," Proc. Globecom, pp. 405.2.1-405.2.5 (Nov. 1990).
Malvar, "A Modulated Complex Lapped Transform and its Applications to Audio Processing," In Proc. IEEE Int. Conf. on Acoustics, Speech, and Signal Processing, Phoenix, AZ, May 1999, pp. 1-9.
Princen et al., "Analysis/Synthesis Filter Bank Design Based on Time Domain Aliasing Cancellation," IEEE Trans. ASSP, pp. 1153-1161 (Oct. 1986).
Schroder et al., "High Quality Digital Audio Encoding with 3.0 Bits/Semple using Adaptive Transform Coding," Proc. 80th Conv. Aud. Eng. Soc., 8 pp. (Mar. 1986).
Theile et al., "Low-Bit Rate Coding of High Quality Audio Signals," Proc. AES, 32 pp. (Mar. 1987).
Wright, "Notes on Ogg Vorbis and the MDCT," www.free-compshop.com, 7 pp. (May 2003).

* cited by examiner

Figure 1, Prior Art
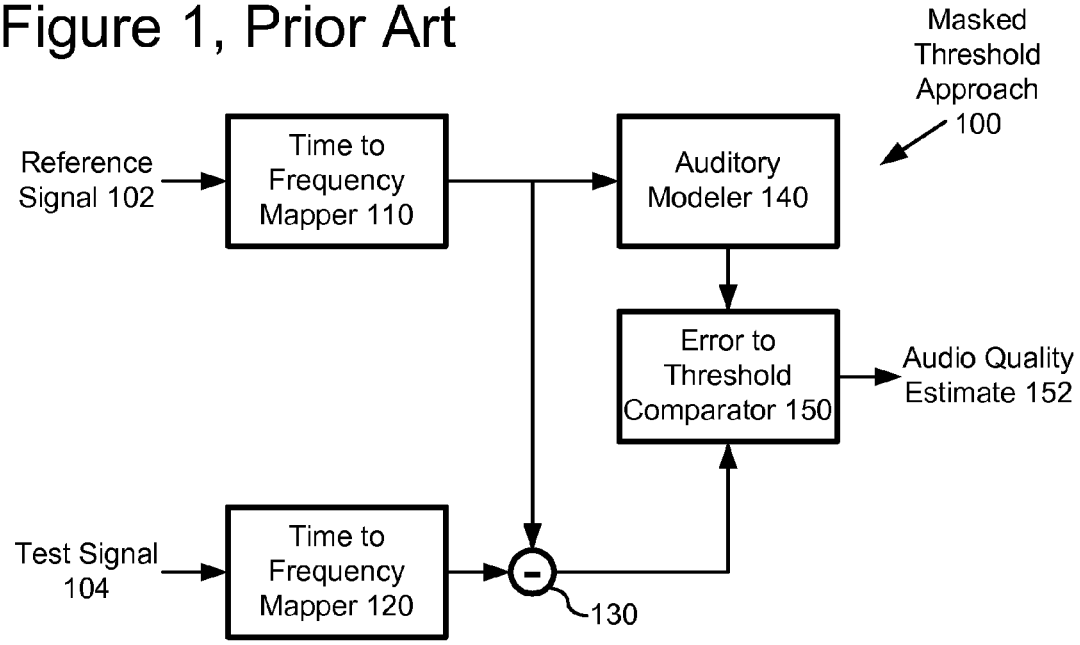
Figure 2
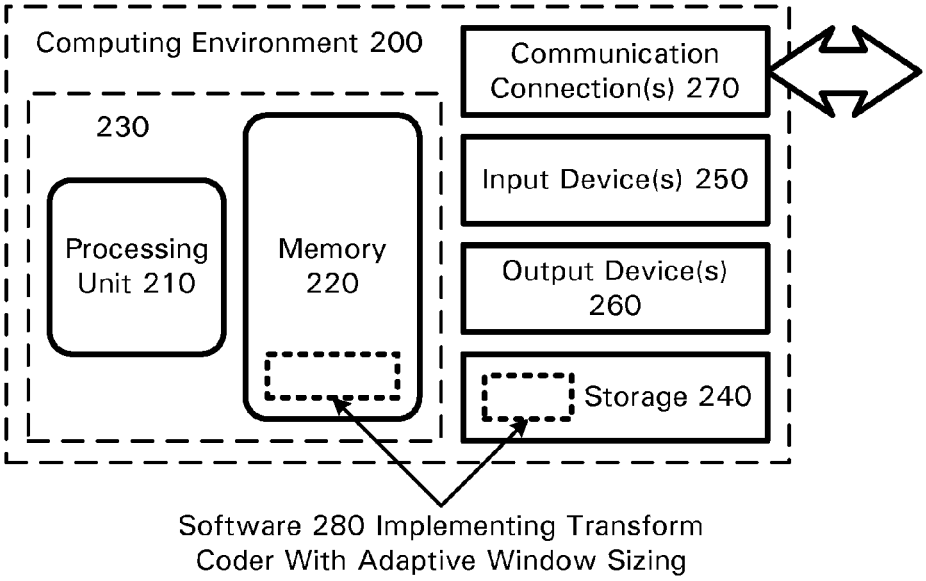

QUALITY IMPROVEMENT TECHNIQUES IN AN AUDIO ENCODER

RELATED APPLICATION INFORMATION

This application is a continuation of U.S. patent application Ser. No. 10/016,918, entitled, "QUALITY IMPROVEMENT TECHNIQUES IN AN AUDIO ENCODER," filed Dec. 14, 2001 now U.S. Pat. No. 7,240,001, the disclosure of which is hereby incorporated by reference in its entirety. The following U.S. patent applications relate to the present application: U.S. patent application Ser. No. 10/017,694, entitled, "QUALITY AND RATE CONTROL STRATEGY FOR DIGITAL AUDIO," filed Dec. 14, 2001, now U.S. Pat. No. 7,027,982, the disclosure of which is hereby incorporated by reference; U.S. patent application Ser. No. 10/017,861, entitled, "TECHNIQUES FOR MEASUREMENT OF PERCEPTUAL AUDIO QUALITY," filed Dec. 14, 2001, now U.S. Pat. No. 7,146,313, the disclosure of which is hereby incorporated by reference; U.S. patent application Ser. No. 10/017,702, entitled, "QUANTIZATION MATRICES FOR DIGITAL AUDIO," filed Dec. 14, 2001, now U.S. Pat. No. 6,934,677, the disclosure of which is hereby incorporated by reference; and U.S. patent application Ser. No. 10/020,708, entitled, "ADAPTIVE WINDOW-SIZE SELECTION IN TRANSFORM CODING," filed Dec. 14, 2001, now U.S. Pat. No. 7,460,993, the disclosure of which is hereby incorporated by reference.

TECHNICAL FIELD

The present invention relates to techniques for improving sound quality of an audio codec (encoder/decoder).

BACKGROUND

The digital transmission and storage of audio signals are increasingly based on data reduction algorithms, which are adapted to the properties of the human auditory system and particularly rely on masking effects. Such algorithms do not mainly aim at minimizing the distortions but rather attempt to handle these distortions in a way that they are perceived as little as possible.

To understand these audio encoding techniques, it helps to understand how audio information is represented in a computer and how humans perceive audio.

I. Representation of Audio Information in a Computer

A computer processes audio information as a series of numbers representing the audio information. For example, a single number can represent an audio sample, which is an amplitude (i.e., loudness) at a particular time. Several factors affect the quality of the audio information, including sample depth, sampling rate, and channel mode.

Sample depth (or precision) indicates the range of numbers used to represent a sample. The more values possible for the sample, the higher the quality is because the number can capture more subtle variations in amplitude. For example, an 8-bit sample has 256 possible values, while a 16-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel modes for audio. In mono mode, audio information is present in one channel. In stereo mode, audio information is present two channels usually labeled the left and right channels. Other modes with more channels, such as 5-channel surround sound, are also possible. Table 1 shows several formats of audio with different quality levels, along with corresponding raw bit rate costs.

TABLE 1

Bit rates for different quality audio information

| Quality | Sample Depth (bits/sample) | Sampling Rate (samples/second) | Mode | Raw Bit rate (bits/second) |
|---|---|---|---|---|
| Internet telephony | 8 | 8,000 | mono | 64,000 |
| telephone | 8 | 11,025 | mono | 88,200 |
| CD audio | 16 | 44,100 | stereo | 1,411,200 |
| high quality audio | 16 | 48,000 | stereo | 1,536,000 |

As Table 1 shows, the cost of high quality audio information such as CD audio is high bit rate. High quality audio information consumes large amounts of computer storage and transmission capacity.

Compression (also called encoding or coding) decreases the cost of storing and transmitting audio information by converting the information into a lower bit rate form. Compression can be lossless (in which quality does not suffer) or lossy (in which quality suffers). Decompression (also called decoding) extracts a reconstructed version of the original information from the compressed form.

Quantization is a conventional lossy compression technique. There are many different kinds of quantization including uniform and non-uniform quantization, scalar and vector quantization, and adaptive and non-adaptive quantization. Quantization maps ranges of input values to single values. For example, with uniform, scalar quantization by a factor of 3.0, a sample with a value anywhere between −1.5 and 1.499 is mapped to 0, a sample with a value anywhere between 1.5 and 4.499 is mapped to 1, etc. To reconstruct the sample, the quantized value is multiplied by the quantization factor, but the reconstruction is imprecise. Continuing the example started above, the quantized value 1 reconstructs to $1\times3=3$; it is impossible to determine where the original sample value was in the range 1.5 to 4.499. Quantization causes a loss in fidelity of the reconstructed value compared to the original value. Quantization can dramatically improve the effectiveness of subsequent lossless compression, however, thereby reducing bit rate.

An audio encoder can use various techniques to provide the best possible quality for a given bit rate, including transform coding, rate control, and modeling human perception of audio. As a result of these techniques, an audio signal can be more heavily quantized at selected frequencies or times to decrease bit rate, yet the increased quantization will not significantly degrade perceived quality for a listener.

Transform coding techniques convert information into a form that makes it easier to separate perceptually important information from perceptually unimportant information. The less important information can then be quantized heavily, while the more important information is preserved, so as to provide the best perceived quality for a given bit rate. Transform coding techniques typically convert information into the frequency (or spectral) domain. For example, a transform coder converts a time series of audio samples into frequency coefficients. Transform coding techniques include Discrete Cosine Transform ["DCT"], Modulated Lapped Transform ["MLT"], and Fast Fourier Transform ["FFT"]. In practice, the input to a transform coder is partitioned into blocks, and each block is transform coded. Blocks may have varying or fixed sizes, and may or may not overlap with an adjacent block. After transform coding, a frequency range of coefficients may be grouped for the purpose of quantization, in which case each coefficient is quantized like the others in the group, and the frequency range is called a quantization band. For more information about transform coding and MLT in particular, see Gibson et al., *Digital Compression for Multimedia*, "Chapter 7: Frequency Domain Coding," Morgan Kaufman Publishers, Inc., pp. 227-262 (1998); U.S. Pat. No. 6,115,689 to Malvar; H. S. Malvar, *Signal Processing with Lapped Transforms*, Artech House, Norwood, Mass., 1992; or Seymour Schlein, "The Modulated Lapped Transform, Its Time-Varying Forms, and Its Application to Audio Coding Standards," IEEE Transactions on Speech and Audio Processing, Vol. 5, No. 4, pp. 359-66, July 1997.

With rate control, an encoder adjusts quantization to regulate bit rate. For audio information at a constant quality, complex information typically has a higher bit rate (is less compressible) than simple information. So, if the complexity of audio information changes in a signal, the bit rate may change. In addition, changes in transmission capacity (such as those due to Internet traffic) affect available bit rate in some applications. The encoder can decrease bit rate by increasing quantization, and vice versa. Because the relation between degree of quantization and bit rate is complex and hard to predict in advance, the encoder can try different degrees of quantization to get the best quality possible for some bit rate, which is an example of a quantization loop.

II. Human Perception of Audio Information

In addition to the factors that determine objective audio quality, perceived audio quality also depends on how the human body processes audio information. For this reason, audio processing tools often process audio information according to an auditory model of human perception.

Typically, an auditory model considers the range of human hearing and critical bands. Humans can hear sounds ranging from roughly 20 Hz to 20 kHz, and are most sensitive to sounds in the 2-4 kHz range. The human nervous system integrates sub-ranges of frequencies. For this reason, an auditory model may organize and process audio information by critical bands. For example, one critical band scale groups frequencies into 24 critical bands with upper cut-off frequencies (in Hz) at 100, 200, 300, 400, 510, 630, 770, 920, 1080, 1270, 1480, 1720, 2000, 2320, 2700, 3150, 3700, 4400, 5300, 6400, 7700, 9500, 12000, and 15500. Different auditory models use a different number of critical bands (e.g., 25, 32, 55, or 109) and/or different cutoff frequencies for the critical bands. Bark bands are a well-known example of critical bands.

Aside from range and critical bands, interactions between audio signals can dramatically affect perception. An audio signal that is clearly audible if presented alone can be completely inaudible in the presence of another audio signal, called the masker or the masking signal. The human ear is relatively insensitive to distortion or other loss in fidelity (i.e., noise) in the masked signal, so the masked signal can include more distortion without degrading perceived audio quality. Table 2 lists various factors and how the factors relate to perception of an audio signal.

TABLE 2

Various factors that relate to perception of audio

| Factor | Relation to Perception of an Audio Signal |
|---|---|
| outer and middle ear transfer | Generally, the outer and middle ear attenuate higher frequency information and pass middle frequency information. Noise is less audible in higher frequencies than middle frequencies. |
| noise in the auditory nerve | Noise present in the auditory nerve, together with noise from the flow of blood, increases for low frequency information. Noise is less audible in lower frequencies than middle frequencies. |
| perceptual frequency scales | Depending on the frequency of the audio signal, hair cells at different positions in the inner ear react, which affects the pitch that a human perceives. Critical bands relate frequency to pitch. |
| Excitation | Hair cells typically respond several milliseconds after the onset of the audio signal at a frequency. After exposure, hair cells and neural processes need time to recover full sensitivity. Moreover, loud signals are processed faster than quiet signals. Noise can be masked when the ear will not sense it. |
| Detection | Humans are better at detecting changes in loudness for quieter signals than louder signals. Noise can be masked in quieter signals. |
| simultaneous masking | For a masker and maskee present at the same time, the maskee is masked at the frequency of the masker but also at frequencies above and below the masker. The amount of masking depends on the masker and maskee structures and the masker frequency. |
| temporal masking | The masker has a masking effect before and after than the masker itself. Generally, forward masking is more pronounced than backward masking. The masking effect diminishes further away from the masker in time. |
| loudness | Perceived loudness of a signal depends on frequency, duration, and sound pressure level. The components of a signal partially mask each other, and noise can be masked as a result. |
| cognitive processing | Cognitive effects influence perceptual audio quality. Abrupt changes in quality are objectionable. Different components of an audio signal are important in different applications (e.g., speech vs. music). |

III. Measuring Audio Quality

In various applications, engineers measure audio quality. For example, quality measurement can be used to evaluate the performance of different audio encoders or other equipment, or the degradation introduced by a particular processing step. For some applications, speed is emphasized over accuracy. For other applications, quality is measured off-line and more rigorously.

Subjective listening tests are one way to measure audio quality. Different people evaluate quality differently, however, and even the same person can be inconsistent over time. By standardizing the evaluation procedure and quantifying the results of evaluation, subjective listening tests can be made more consistent, reliable, and reproducible. In many applications, however, quality must be measured quickly or results must be very consistent over time, so subjective listening tests are inappropriate.

Conventional measures of objective audio quality include signal to noise ratio ["SNR"] and distortion of the reconstructed audio signal compared to the original audio signal. SNR is the ratio of the amplitude of the noise to the amplitude of the signal, and is usually expressed in terms of decibels. Distortion D can be calculated as the square of the differences between original values and reconstructed values.

$$D=(u-q(u)Q)^2 \tag{1}$$

where u is an original value, q(u) is a quantized version of the original value, and Q is a quantization factor. Both SNR and distortion are simple to calculate, but fail to account for the audibility of noise. Namely, SNR and distortion fail to account for the varying sensitivity of the human ear to noise at different frequencies and levels of loudness, interaction with other sounds present in the signal (i.e., masking), or the physical limitations of the human ear (i.e., the need to recover sensitivity). Both SNR and distortion fail to accurately predict perceived audio quality in many cases.

ITU-R BS 1387 is an international standard for objectively measuring perceived audio quality. The standard describes several quality measurement techniques and auditory models. The techniques measure the quality of a test audio signal compared to a reference audio signal, in mono or stereo mode.

FIG. 1 shows a masked threshold approach (100) to measuring audio quality described in ITU-R BS 1387, Annex 1, Appendix 4, Sections 2, 3, and 4.2. In the masked threshold approach (100), a first time to frequency mapper (110) maps a reference signal (102) to frequency data, and a second time to frequency mapper (120) maps a test signal (104) to frequency data. A subtractor (130) determines an error signal from the difference between the reference signal frequency data and the test signal frequency data. An auditory modeler (140) processes the reference signal frequency data, including calculation of a masked threshold for the reference signal. The error to threshold comparator (150) then compares the error signal to the masked threshold, generating an audio quality estimate (152), for example, based upon the differences in levels between the error signal and the masked threshold.

ITU-R BS 1387 describes in greater detail several other quality measures and auditory models. In a FFT-based ear model, reference and test signals at 48 kHz are each split into windows of 2048 samples such that there is 50% overlap across consecutive windows. A Hann window function and FFT are applied, and the resulting frequency coefficients are filtered to model the filtering effects of the outer and middle ear. An error signal is calculated as the difference between the frequency coefficients of the reference signal and those of the test signal. For each of the error signal, the reference signal, and the test signal, the energy is calculated by squaring the signal values. The energies are then mapped to critical bands/pitches. For each critical band, the energies of the coefficients contributing to (e.g., within) that critical band are added together. For the reference signal and the test signal, the energies for the critical bands are then smeared across frequencies and time to model simultaneous and temporal masking. The outputs of the smearing are called excitation patterns. A masking threshold can then be calculated for an excitation pattern:

$$M[k,n] = \frac{E[k,n]}{10^{\frac{m[k]}{10}}} \tag{2}$$

for m[k]=3.0 if k*res≦12 and m[k]=k*res if k*res>12, where k is the critical band, res is the resolution of the band scale in terms of Bark bands, n is the frame, and E[k,n] is the excitation pattern.

From the excitation patterns, error signal, and other outputs of the ear model, ITU-R BS 1387 describes calculating Model Output Variables ["MOVs"]. One MOV is the average noise to mask ratio ["NMR"] for a frame:

$$NMR_{local}[n] = 10 * \log_{10} \frac{1}{Z} \sum_{k=0}^{Z-1} \frac{P_{noise}[k,n]}{M[k,n]} \tag{3}$$

where n is the frame number, Z is the number of critical bands per frame, $P_{noise}$[k,n] is the noise pattern, and M[k,n] is the masking threshold. NMR can also be calculated for a whole signal as a combination of NMR values for frames.

In ITU-R BS 1387, NMR and other MOVs are weighted and aggregated to give a single output quality value. The weighting ensures that the single output value is consistent with the results of subjective listening tests. For stereo signals, the linear average of MOVs for the left and right channels is taken. For more information about the FFT-based ear model and calculation of NMR and other MOVs, see ITU-R BS 1387, Annex 2, Sections 2.1 and 4-6. ITU-R BS 1387 also describes a filter bank-based ear model. The Beerends reference also describes audio quality measurement, as does Solari, *Digital Video and Audio Compression*, "Chapter 8: Sound and Audio," McGraw-Hill, Inc., pp. 187-212 (1997).

Compared to subjective listening tests, the techniques described in ITU-R BS 1387 are more consistent and reproducible. Nonetheless, the techniques have several shortcomings. First, the techniques are complex and time-consuming, which limits their usefulness for real-time applications. For example, the techniques are too complex to be used effectively in a quantization loop in an audio encoder. Second, the NMR of ITU-R BS 1387 measures perceptible degradation compared to the masking threshold for the original signal, which can inaccurately estimate the perceptible degradation for a listener of the reconstructed signal. For example, the masking threshold of the original signal can be higher or lower than the masking threshold of the reconstructed signal due to the effects of quantization. A masking component in the original signal might not even be present in the reconstructed signal. Third, the NMR of ITU-R BS 1387 fails to adequately weight NMR on a per-band basis, which limits its usefulness and adaptability. Aside from these shortcomings, the techniques described in ITU-R BS 1387 present several practical problems for an audio encoder. The techniques presuppose input at a fixed rate (48 kHz). The techniques assume fixed transform block sizes, and use a transform and window function (in the FFT-based ear model) that can be different than the transform used in the encoder, which is inefficient. Finally, the number of quantization bands used in the encoder is not necessarily equal to the number of critical bands in an auditory model of ITU-R BS 1387.

Microsoft Corporation's Windows Media Audio version 7.0 ["WMA7"] partially addresses some of the problems with implementing quality measurement in an audio encoder. In WMA7, the encoder may jointly code the left and right channels of stereo mode audio into a sum channel and a difference channel. The sum channel is the averages of the left and right channels; the difference channel is the differences between the left and right channels divided by two. The encoder calculates a noise signal for each of the sum channel and the difference channel, where the noise signal is the difference between the original channel and the reconstructed channel. The encoder then calculates the maximum Noise to Excitation Ratio ["NER"] of all quantization bands in the sum channel and difference channel:

$$NER_{max\ of\ all\ d} = \max\left(\max_d\left(\frac{F_{Diff}[d]}{E_{Diff}[d]}\right), \max_d\left(\frac{F_{Sum}[d]}{E_{Sum}[d]}\right)\right) \tag{4}$$

where d is the quantization band number, $\max_d$ is the maximum value across all d, and $E_{Diff}$[d], $E_{Sum}$[d], $F_{Diff}$[d], and $F_{Sum}$[d] are the excitation pattern for the difference channel, the excitation pattern for the sum channel, the noise pattern of the difference channel, and the noise pattern of the sum channel, respectively, for quantization bands. In WMA7, calculating an excitation or noise pattern includes squaring values to determine energies, and then, for each quantization band, adding the energies of the coefficients within that quantization band. If WMA7 does not use jointly coded channels, the same equation is used to measure the quality of left and right channels. That is, $$NER_{max\ of\ all\ d} = \max\left(\max_d\left(\frac{F_{Left}[d]}{E_{Left}[d]}\right), \max_d\left(\frac{F_{Right}[d]}{E_{Right}[d]}\right)\right) \quad (5)$$

WMA7 works in real time and measures audio quality for input with rates other than 48 kHz. WMA7 uses a MLT with variable transform block sizes, and measures audio quality using the same frequency coefficients used in compression. WMA7 does not address several of the problems of ITU-R BS 1387, however, and WMA7 has several other shortcomings as well, each of which decreases the accuracy of the measurement of perceptual audio quality. First, although the quality measurement of WMA7 is simple enough to be used in a quantization loop of the audio encoder, it does not adequately correlate with actual human perception. As a result, changes in quality in order to keep constant bit rate can be dramatic and perceptible. Second, the NER of WMA7 measures perceptible degradation compared to the excitation pattern of the original information (as opposed to reconstructed information), which can inaccurately estimate perceptible degradation for a listener of the reconstructed signal. Third, the NER of WMA7 fails to adequately weight NER on a per-band basis, which limits its usefulness and adaptability. Fourth, although WMA7 works with variable-size transform blocks, WMA7 is unable perform operations such as temporal masking between blocks due to the variable sizes. Fifth, WMA7 measures quality with respect to excitation and noise patterns for quantization bands, which are not necessarily related to a model of human perception with critical bands, and which can be different in different variable-size blocks, preventing comparisons of results. Sixth, WMA7 measures the maximum NER for all quantization bands of a channel, which can inappropriately ignore the contribution of NER s for other quantization bands. Seventh, WMA7 applies the same quality measurement techniques whether independently or jointly coded channels are used, which ignores differences between the two channel modes.

Aside from WMA7, several international standards describe audio encoders that incorporate an auditory model. The Motion Picture Experts Group, Audio Layer 3 ["MP3"] and Motion Picture Experts Group 2, Advanced Audio Coding ["AAC"] standards each describe techniques for measuring distortion in a reconstructed audio signal against thresholds set with an auditory model.

In MP3, the encoder incorporates a psychoacoustic model to calculate Signal to Mask Ratios ["SMRs"] for frequency ranges called threshold calculation partitions. In a path separate from the rest of the encoder, the encoder processes the original audio information according to the psychoacoustic model The psychoacoustic model uses a different frequency transform than the rest of the encoder (FFT vs. hybrid polyphase/MDCT filter bank) and uses separate computations for energy and other parameters. In the psychoacoustic model, the MP3 encoder processes blocks of frequency coefficients according to the threshold calculation partitions, which have sub-Bark band resolution (e.g., 62 partitions for a long block of 48 kHz input). The encoder calculates a SMR for each partition. The encoder converts the SMRs for the partitions into SMRs for scale factor bands. A scale factor band is a range of frequency coefficients for which the encoder calculates a weight called a scale factor. The number of scale factor bands depends on sampling rate and block size (e.g., 21 scale factor bands for a long block of 48 kHz input). The encoder later converts the SMRs for the scale factor bands into allowed distortion thresholds for the scale factor bands.

In an outer quantization loop, the MP3 encoder compares distortions for scale factor bands to the allowed distortion thresholds for the scale factor bands. Each scale factor starts with a minimum weight for a scale factor band. For the starting set of scale factors, the encoder finds a satisfactory quantization step size in an inner quantization loop. In the outer quantization loop, the encoder amplifies the scale factors until the distortion in each scale factor band is less than the allowed distortion threshold for that scale factor band, with the encoder repeating the inner quantization loop for each adjusted set of scale factors. In special cases, the encoder exits the outer quantization loop even if distortion exceeds the allowed distortion threshold for a scale factor band (e.g., if all scale factors have been amplified or if a scale factor has reached a maximum amplification).

Before the quantization loops, the MP3 encoder can switch between long blocks of 576 frequency coefficients and short blocks of 192 frequency coefficients (sometimes called long windows or short windows). Instead of a long block, the encoder can use three short blocks for better time resolution. The number of scale factor bands is different for short blocks and long blocks (e.g., 12 scale factor bands vs. 21 scale factor bands). The MP3 encoder runs the psychoacoustic model twice (in parallel, once for long blocks and once for short blocks) using different techniques to calculate SMR depending on the block size.

The MP3 encoder can use any of several different coding channel modes, including single channel, two independent channels (left and right channels), or two jointly coded channels (sum and difference channels). If the encoder uses jointly coded channels, the encoder computes a set of scale factors for each of the sum and difference channels using the same techniques that are used for left and right channels. Or, if the encoder uses jointly coded channels, the encoder can instead use intensity stereo coding. Intensity stereo coding changes how scale factors are determined for higher frequency scale factor bands and changes how sum and difference channels are reconstructed, but the encoder still computes two sets of scale factors for the two channels.

For additional information about MP3 and AAC, see the MP3 standard ("ISO/IEC 11172-3, Information Technology—Coding of Moving Pictures and Associated Audio for Digital Storage Media at Up to About 1.5 Mbit/s—Part 3: Audio") and the MC standard.

Although MP3 encoding has achieved widespread adoption, it is unsuitable for some applications (for example, real-time audio streaming at very low to mid bit rates) for several reasons. First, calculating SMRs and allowed distortion thresholds with MP3's psychoacoustic model occurs outside of the quantization loops. The psychoacoustic model is too complex for some applications, and cannot be integrated into a quantization loop for such applications. At the same time, as the psychoacoustic model is outside of the quantization loops, it works with original audio information (as opposed to reconstructed audio information), which can lead to inaccurate estimation of perceptible degradation for a listener of the reconstructed signal at lower bit rates. Second, the MP3 encoder fails to adequately weight SMRs and allowed distortion thresholds on a per-band basis, which limits the usefulness and adaptability of the MP3 encoder. Third, computing SMRs and allowed distortion thresholds in separate tracks for long blocks and short blocks prevents or complicates operations such as temporal spreading or comparing measures for blocks of different sizes. Fourth, the MP3 encoder does not adequately exploit differences between independently coded channels and jointly coded channels when calculating SMRs and allowed distortion thresholds.

SUMMARY

Embodiments of an audio encoder are described herein that digitally encode audio signals with improved audio quality.

In a first audio encoding technique, an audio encoder dynamically selects between joint and independent coding of a multi-channel audio signal using an open-loop selection decision based upon (a) energy separation between the coding channels, and (b) the disparity between excitation patterns of the separate input channels.

In a second audio encoding technique, an audio encoder performs band truncation to suppress a few higher frequency transform coefficients, so as to permit better coding of surviving coefficients. In one implementation, the audio encoder determines a cut-off frequency as a function of a perceptual quality measure (e.g., a noise-to-excitation ratio ("NER") of the input signal). This way, if the content being compressed is not complex, less of such filtering is performed.

In a third audio encoding technique, an audio encoder performs channel re-matrixing when jointly encoding a multi-channel audio signal. In one implementation, the audio encoder suppresses certain coefficients of a difference channel by scaling according to a scale factor, which is based on (a) current average levels of perceptual quality, (b) current rate control buffer fullness, (c) coding mode (e.g., bit rate and sample rate settings, etc.), and (d) the amount of channel separation in the source. For example, if the current average perceptual quality measure indicates poor reproduction, the scale factor is varied to cause severe suppression of the difference channel in re-matrixing. Similar severe re-matrixing is performed as the rate control buffer approaches fullness. Conversely, if the two channels of the input audio signal significantly differ, the scale factor is varied so that little or no re-matrixing takes place.

In a fourth audio encoding technique, an audio encoder reduces the size of a quantization matrix in the encoded audio signal. The quantization matrix encodes quantizer step size of quantization bands of an encoded channel in the encoded audio signal. In one implementation, the quantization matrix is differentially encoded for successive frames of the audio signal. At certain (e.g., lower) coding rates, particular quantization bands may be quantized to all zeroes (e.g., due to quantization or band truncation). In such cases, the audio encoder reduces the bits needed to differentially encode the quantization matrices of successive frames by modifying the quantization step size of bands that are quantized to zero, so as to be differentially encoded using fewer bits. For example, the various bands that are quantized to zero may initially have various quantization step sizes. Via this technique, the audio encoder may adjust the quantization step sizes of these bands to be identical so that they may be differentially encoded in the quantization matrix using fewer bits.

BRIEF DESCRIPTION OF THE DRAWINGS

FIG. 1 is a diagram of a masked threshold approach to measuring audio quality according to the prior art.

FIG. 2 is a block diagram of a suitable computing environment for an audio encoder incorporating quality enhancement techniques described herein.

DETAILED DESCRIPTION

Figure 3:
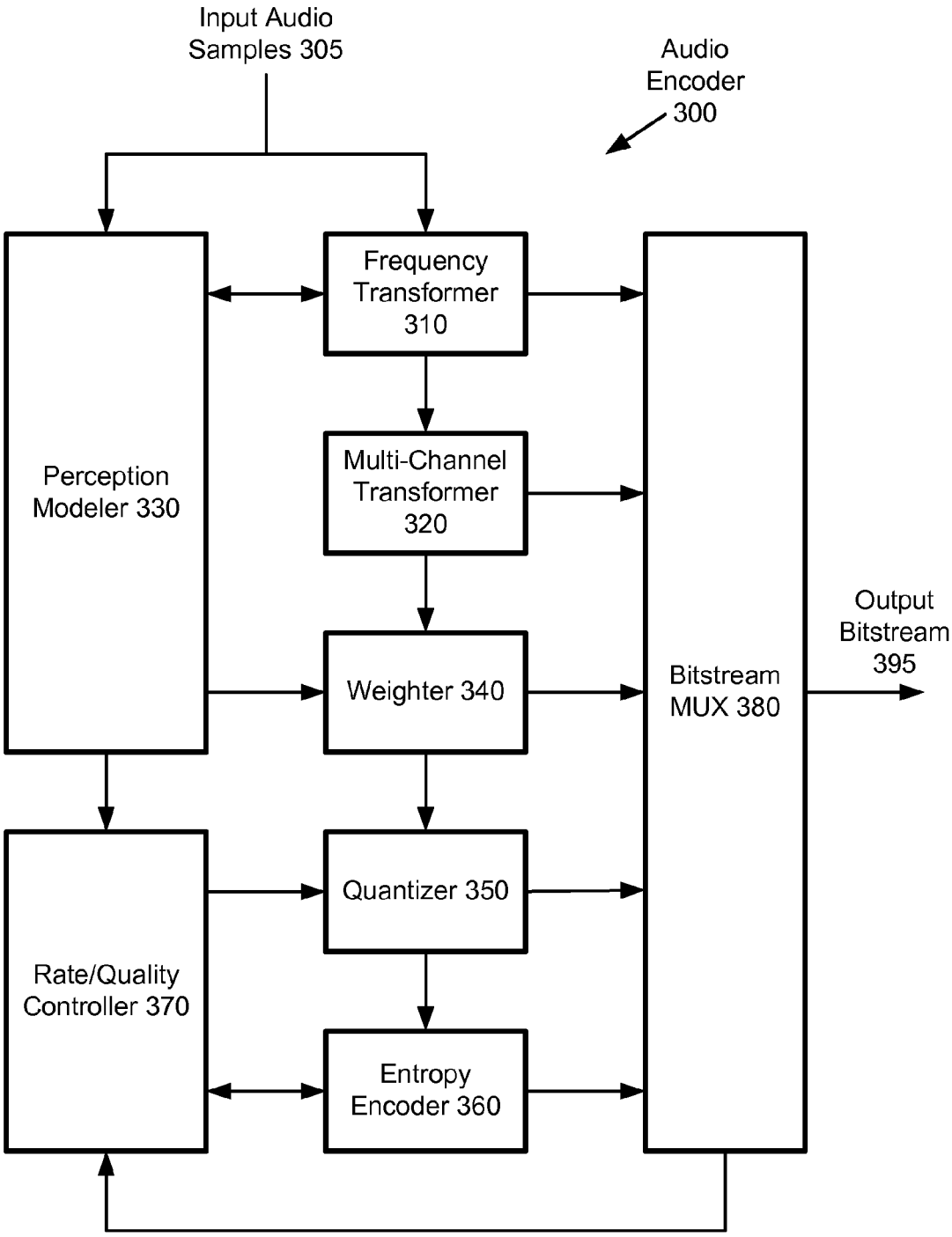
FIGS. 3 and 4 are a block diagram of an audio encoder and decoder in which quality enhancement techniques described herein are incorporated.

The following detailed description addresses embodiments of an audio encoder that implements various audio quality improvements. The audio encoder incorporates an improved multi-channel coding decision based on energy separation and excitation pattern disparity between channels. The audio encoder further performs band truncation at a cut-off frequency based on a perceptual quality measure. The audio encoder also performs multi-channel rematrixing with suppression based on (a) current average levels of perceptual quality, (b) current rate control buffer fullness, (c) coding mode (e.g., bit rate and sample rate settings, etc.), and (d) the amount of channel separation in the source. The audio encoder also adjusts step size of zero-quantized quantization bands for efficient coding of the quantization matrix, such as in frame headers.

I. Computing Environment

FIG. 2 illustrates a generalized example of a suitable computing environment (200) in which the illustrative embodiment may be implemented. The computing environment (200) is not intended to suggest any limitation as to scope of use or functionality of the invention, as the present invention may be implemented in diverse general-purpose or special-purpose computing environments.

With reference to FIG. 2, the computing environment (200) includes at least one processing unit (210) and memory (220). In FIG. 2, this most basic configuration (230) is included within a dashed line. The processing unit (210) executes computer-executable instructions and may be a real or a virtual processor. In a multi-processing system, multiple processing units execute computer-executable instructions to increase processing power. The memory (220) may be volatile memory (e.g., registers, cache, RAM), non-volatile memory (e.g., ROM, EEPROM, flash memory, etc.), or some combination of the two. The memory (220) stores software (280) implementing an audio encoder.

A computing environment may have additional features. For example, the computing environment (200) includes storage (240), one or more input devices (250), one or more output devices (260), and one or more communication connections (270). An interconnection mechanism (not shown) such as a bus, controller, or network interconnects the components of the computing environment (200). Typically, operating system software (not shown) provides an operating environment for other software executing in the computing environment (200), and coordinates activities of the components of the computing environment (200).

The storage (240) may be removable or non-removable, and includes magnetic disks, magnetic tapes or cassettes, CD-ROMs, CD-RWs, DVDs, or any other medium which can be used to store information and which can be accessed within the computing environment (200). The storage (240) stores instructions for the software (280) implementing the audio encoder.

The input device(s) (250) may be a touch input device such as a keyboard, mouse, pen, or trackball, a voice input device, a scanning device, or another device that provides input to the computing environment (200). For audio, the input device(s) (250) may be a sound card or similar device that accepts audio input in analog or digital form. The output device(s) (260) may be a display, printer, speaker, or another device that provides output from the computing environment (200).

The communication connection(s) (270) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (200), computer-readable media include memory (220), storage (240), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer executable instructions for program modules may be executed within a local or distributed computing environment.

For the sake of presentation, the detailed description uses terms like "determine," "get," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Audio Encoder and Decoder

FIG. 3 is a block diagram of a generalized audio encoder (300). The relationships shown between modules within the encoder and decoder indicate the main flow of information in the encoder and decoder; other relationships are not shown for the sake of simplicity. Depending on implementation and the type of compression desired, modules of the encoder or decoder can be added, omitted, split into multiple modules, combined with other modules, and/or replaced with like modules. In alternative embodiments, encoders or decoders with different modules and/or other configurations of modules measure perceptual audio quality.

A. Generalized Audio Encoder

The generalized audio encoder (300) includes a frequency transformer (31 0), a multi-channel transformer (320), a perception modeler (330), a weighter (340), a quantizer (350), an entropy encoder (360), a rate/quality controller (370), and a bitstream multiplexer ["MUX"] (380).

The encoder (300) receives a time series of input audio samples (305) in a format such as one shown in Table 1. For input with multiple channels (e.g., stereo mode), the encoder (300) processes channels independently, and can work with jointly coded channels following the multi-channel transformer (320). The encoder (300) compresses the audio samples (305) and multiplexes information produced by the various modules of the encoder (300) to output a bitstream (395) in a format such as Windows Media Audio ["WMA"] or Advanced Streaming Format ["ASF"]. Alternatively, the encoder (300) works with other input and/or output formats.

The frequency transformer (310) receives the audio samples (305) and converts them into data in the frequency domain. The frequency transformer (310) splits the audio samples (305) into blocks, which can have variable size to allow variable temporal resolution. Small blocks allow for greater preservation of time detail at short but active transition segments in the input audio samples (305), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. The frequency transformer (310) outputs blocks of frequency coefficient data to the multi-channel transformer (320) and outputs side information such as block sizes to the MUX (380). The frequency transformer (310) outputs both the frequency coefficient data and the side information to the perception modeler (330).

The frequency transformer (310) partitions a frame of audio input samples (305) into overlapping sub-frame blocks with time-varying size and applies a time-varying MLT to the sub-frame blocks. Possible sub-frame sizes include 128, 256, 512, 1024, 2048, and 4096 samples. The MLT operates like a DCT modulated by a time window function, where the window function is time varying and depends on the sequence of sub-frame sizes. The MLT transforms a given overlapping block of samples $x[n], 0 \leqq n < subframe_size$ into a block of frequency coefficients X[k],0≦k<subframe_size/2. The frequency transformer (310) can also output estimates of the complexity of future frames to the rate/quality controller (370). Alternative embodiments use other varieties of MLT. In still other alternative embodiments, the frequency transformer (310) applies a DCT, FFT, or other type of modulated or non-modulated, overlapped or non-overlapped frequency transform, or use subband or wavelet coding.

For multi-channel audio data, the multiple channels of frequency coefficient data produced by the frequency transformer (310) often correlate. To exploit this correlation, the multi-channel transformer (320) can convert the multiple original, independently coded channels into jointly coded channels. For example, if the input is stereo mode, the multi-channel transformer (320) can convert the left and right channels into sum and difference channels:

$$X_{Sum}[k] = \frac{X_{Left}[k] + X_{Right}[k]}{2} \tag{6}$$

$$X_{Diff}[k] = \frac{X_{Left}[k] - X_{Right}[k]}{2} \tag{7}$$

Or, the multi-channel transformer (320) can pass the left and right channels through as independently coded channels. More generally, for a number of input channels greater than one, the multi-channel transformer (320) passes original, independently coded channels through unchanged or converts the original channels into jointly coded channels. The decision to use independently or jointly coded channels can be predetermined, or the decision can be made adaptively on a block by block or other basis during encoding. The multi-channel transformer (320) produces side information to the MUX (380) indicating the channel mode used.

The perception modeler (330) models properties of the human auditory system to improve the quality of the reconstructed audio signal for a given bit rate. The perception modeler (330) computes the excitation pattern of a variable-size block of frequency coefficients. First, the perception modeler (330) normalizes the size and amplitude scale of the block. This enables subsequent temporal smearing and establishes a consistent scale for quality measures. Optionally, the perception modeler (330) attenuates the coefficients at certain frequencies to model the outer/middle ear transfer function. The perception modeler (330) computes the energy of the coefficients in the block and aggregates the energies by 25 critical bands. Alternatively, the perception modeler (330) uses another number of critical bands (e.g., 55 or 109). The frequency ranges for the critical bands are implementation-dependent, and numerous options are well known. For example, see ITU-R BS 1387 or a reference mentioned therein. The perception modeler (330) processes the band energies to account for simultaneous and temporal masking. In alternative embodiments, the perception modeler (330) processes the audio data according to a different auditory model, such as one described or mentioned in ITU-R BS 1387.

The weighter (340) generates weighting factors (alternatively called a quantization matrix) based upon the excitation pattern received from the perception modeler (330) and applies the weighting factors to the data received from the multi-channel transformer (320). The weighting factors include a weight for each of multiple quantization bands in the audio data. The quantization bands can be the same or different in number or position from the critical bands used elsewhere in the encoder (300). The weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. In one implementation, the number of quantization bands varies according to block size; smaller blocks have fewer quantization bands than larger blocks. For example, blocks with 128 coefficients have 13 quantization bands, blocks with 256 coefficients have 15 quantization bands, up to 25 quantization bands for blocks with 2048 coefficients. The weighter (340) generates a set of weighting factors for each channel of multi-channel audio data in independently coded channels, or generates a single set of weighting factors for jointly coded channels. In alternative embodiments, the weighter (340) generates the weighting factors from information other than or in addition to excitation patterns.

The weighter (340) outputs weighted blocks of coefficient data to the quantizer (350) and outputs side information such as the set of weighting factors to the MUX (380). The weighter (340) can also output the weighting factors to the rate/quality controller (340) or other modules in the encoder (300). The set of weighting factors can be compressed for more efficient representation. If the weighting factors are lossy compressed, the reconstructed weighting factors are typically used to weight the blocks of coefficient data. If audio information in a band of a block is completely eliminated for some reason (e.g., noise substitution or band truncation), the encoder (300) may be able to further improve the compression of the quantization matrix for the block.

The quantizer (350) quantizes the output of the weighter (340), producing quantized coefficient data to the entropy encoder (360) and side information including quantization step size to the MUX (380). Quantization introduces irreversible loss of information, but also allows the encoder (300) to regulate the bit rate of the output bitstream (395) in conjunction with the rate/quality controller (370). In FIG. 3, the quantizer (350) is an adaptive, uniform scalar quantizer. The quantizer (350) applies the same quantization step size to each frequency coefficient, but the quantization step size itself can change from one iteration to the next to affect the bit rate of the entropy encoder (360) output. In alternative embodiments, the quantizer is a non-uniform quantizer, a vector quantizer, and/or a non-adaptive quantizer.

The entropy encoder (360) losslessly compresses quantized coefficient data received from the quantizer (350). For example, the entropy encoder (360) uses multi-level run length coding, variable-to-variable length coding, run length coding, Huffman coding, dictionary coding, arithmetic coding, LZ coding, a combination of the above, or some other entropy encoding technique.

The rate/quality controller (370) works with the quantizer (350) to regulate the bit rate and quality of the output of the encoder (300). The rate/quality controller (370) receives information from other modules of the encoder (300). In one implementation, the rate/quality controller (370) receives estimates of future complexity from the frequency transformer (310), sampling rate, block size information, the excitation pattern of original audio data from the perception modeler (330), weighting factors from the weighter (340), a block of quantized audio information in some form (e.g., quantized, reconstructed, or encoded), and buffer status information from the MUX (380). The rate/quality controller (370) can include an inverse quantizer, an inverse weighter, an inverse multi-channel transformer, and, potentially, an entropy decoder and other modules, to reconstruct the audio data from a quantized form.

The rate/quality controller (370) processes the information to determine a desired quantization step size given current conditions and outputs the quantization step size to the quantizer (350). The rate/quality controller (370) then measures the quality of a block of reconstructed audio data as quantized with the quantization step size, as described below. Using the measured quality as well as bit rate information, the rate/quality controller (370) adjusts the quantization step size with the goal of satisfying bit rate and quality constraints, both instantaneous and long-term. In alternative embodiments, the rate/quality controller (370) applies works with different or additional information, or applies different techniques to regulate quality and bit rate.

In conjunction with the rate/quality controller (370), the encoder (300) can apply noise substitution, band truncation, and/or multi-channel rematrixing to a block of audio data. At low and mid-bit rates, the audio encoder (300) can use noise substitution to convey information in certain bands. In band truncation, if the measured quality for a block indicates poor quality, the encoder (300) can completely eliminate the coefficients in certain (usually higher frequency) bands to improve the overall quality in the remaining bands. In multi-channel rematrixing, for low bit rate, multi-channel audio data in jointly coded channels, the encoder (300) can suppress information in certain channels (e.g., the difference channel) to improve the quality of the remaining channel(s) (e.g., the sum channel).

The MUX (380) multiplexes the side information received from the other modules of the audio encoder (300) along with the entropy encoded data received from the entropy encoder (360). The MUX (380) outputs the information in WMA or in another format that an audio decoder recognizes.

The MUX (380) includes a virtual buffer that stores the bitstream (395) to be output by the encoder (300). The virtual buffer stores a pre-determined duration of audio information (e.g., 5 seconds for streaming audio) in order to smooth over short-term fluctuations in bit rate due to complexity changes in the audio. The virtual buffer then outputs data at a relatively constant bit rate. The current fullness of the buffer, the rate of change of fullness of the buffer, and other characteristics of the buffer can be used by the rate/quality controller (370) to regulate quality and bit rate.

B. Generalized Audio Decoder

Figure 4:
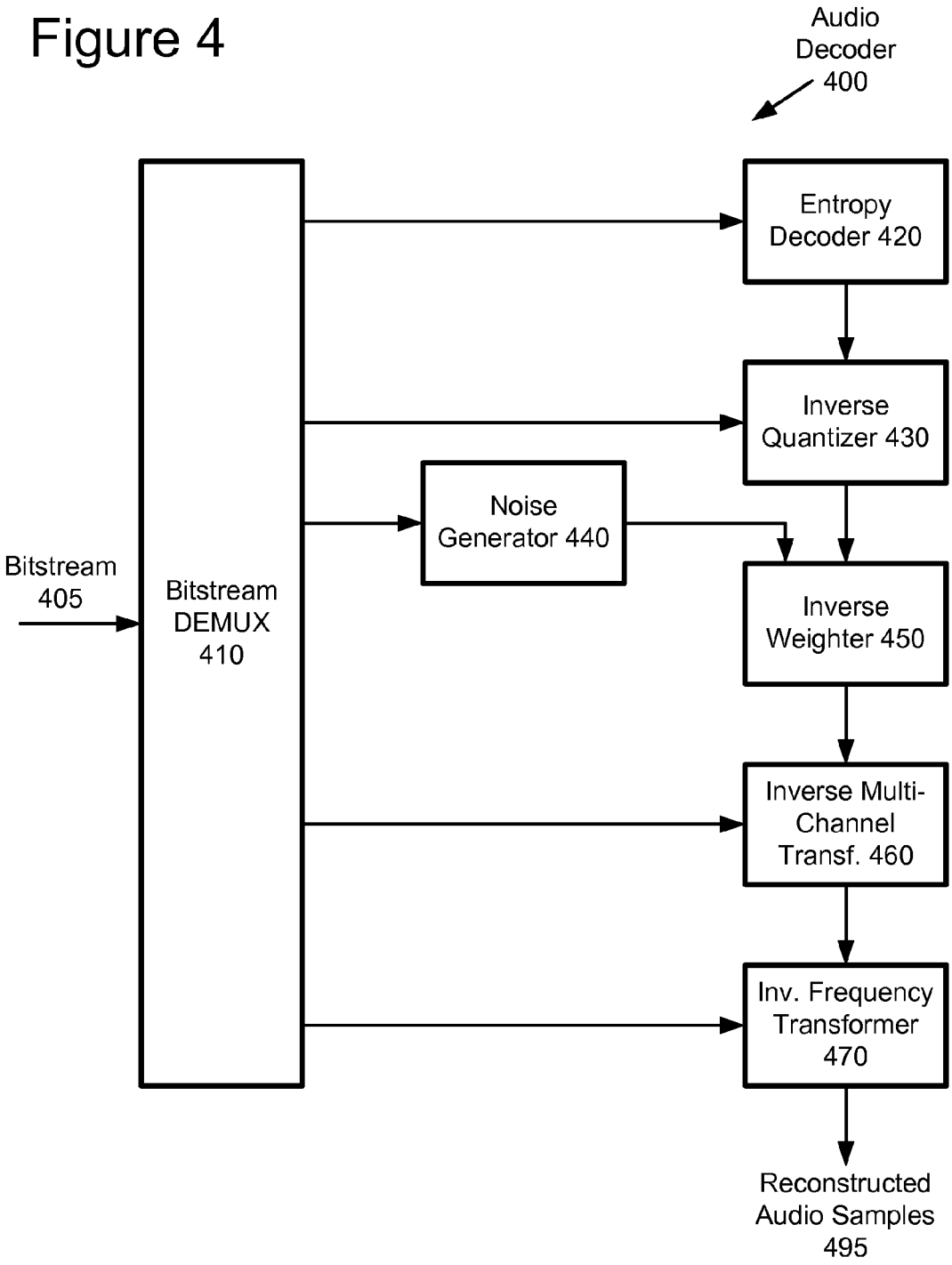

With reference to FIG. 4, the generalized audio decoder (400) includes a bitstream demultiplexer ["DEMUX"] (410), an entropy decoder (420), an inverse quantizer (430), a noise generator (440), an inverse weighter (450), an inverse multi-channel transformer (460), and an inverse frequency transformer (470). The decoder (400) is simpler than the encoder (300) is because the decoder (400) does not include modules for rate/quality control.

The decoder (400) receives a bitstream (405) of compressed audio data in WMA or another format. The bitstream (405) includes entropy encoded data as well as side information from which the decoder (400) reconstructs audio samples (495). For audio data with multiple channels, the decoder (400) processes each channel independently, and can work with jointly coded channels before the inverse multi-channel transformer (460).

The DEMUX (410) parses information in the bitstream (405) and sends information to the modules of the decoder (400). The DEMUX (410) includes one or more buffers to compensate for short-term variations in bit rate due to fluctuations in complexity of the audio, network jitter, and/or other factors.

The entropy decoder (420) losslessly decompresses entropy codes received from the DEMUX (410), producing quantized frequency coefficient data. The entropy decoder (420) typically applies the inverse of the entropy encoding technique used in the encoder.

The inverse quantizer (430) receives a quantization step size from the DEMUX (410) and receives quantized frequency coefficient data from the entropy decoder (420). The inverse quantizer (430) applies the quantization step size to the quantized frequency coefficient data to partially reconstruct the frequency coefficient data. In alternative embodiments, the inverse quantizer applies the inverse of some other quantization technique used in the encoder.

The noise generator (440) receives from the DEMUX (410) indication of which bands in a block of data are noise substituted as well as any parameters for the form of the noise. The noise generator (440) generates the patterns for the indicated bands, and passes the information to the inverse weighter (450).

The inverse weighter (450) receives the weighting factors from the DEMUX (410), patterns for any noise-substituted bands from the noise generator (440), and the partially reconstructed frequency coefficient data from the inverse quantizer (430). As necessary, the inverse weighter (450) decompresses the weighting factors. The inverse weighter (450) applies the weighting factors to the partially reconstructed frequency coefficient data for bands that have not been noise substituted. The inverse weighter (450) then adds in the noise patterns received from the noise generator (440).

The inverse multi-channel transformer (460) receives the reconstructed frequency coefficient data from the inverse weighter (450) and channel mode information from the DEMUX (410). If multi-channel data is in independently coded channels, the inverse multi-channel transformer (460) passes the channels through. If multi-channel data is in jointly coded channels, the inverse multi-channel transformer (460) converts the data into independently coded channels. If desired, the decoder (400) can measure the quality of the reconstructed frequency coefficient data at this point.

The inverse frequency transformer (470) receives the frequency coefficient data output by the multi-channel transformer (460) as well as side information such as block sizes from the DEMUX (410). The inverse frequency transformer (470) applies the inverse of the frequency transform used in the encoder and outputs blocks of reconstructed audio samples (495).

III. Multi-Channel Coding Decision

Figure 5:
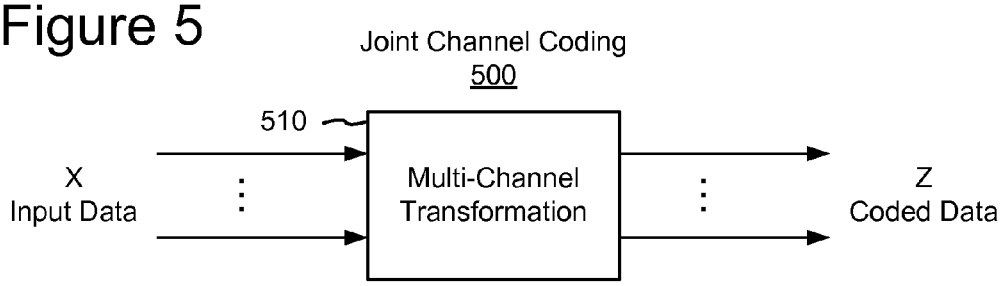
FIG. 5 is a flow diagram of joint channel coding in the audio encoder of FIG. 3.
Figure 6:
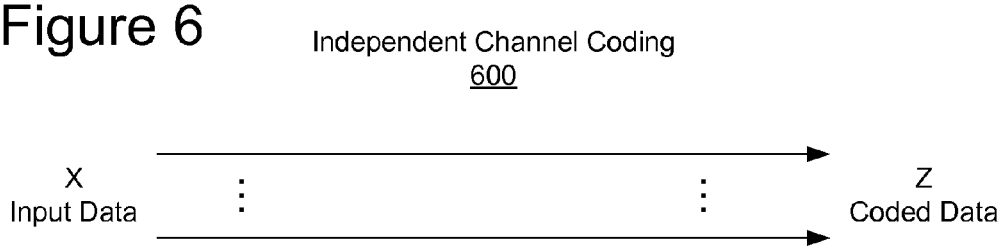
FIG. 6 is a flow diagram of independent channel coding in the audio encoder of FIG. 3.

As described above, the audio encoder 300 (FIG. 3) can dynamically decide between encoding a multiple channel input audio signal in a joint channel coding mode or an independent channel coding mode, such as on a block-by-block or other basis, for improved compression efficiency. In joint channel coding 500 (FIG. 5), the audio encoder applies a multi-channel transformation 510 on multiple channels of the input signal to produce coding channels, which are then transform encoded (erg., via frequency transform, quantization, and entropy encoding processes described above). An example of a multi-channel transformation is the conversion of left and right stereo channels into sum and difference channels using the equations (1) and (2) given above. In alternative embodiments, the joint coding can be performed on other multiple channel input signals, such as 5.1 channel surround sound, etc. Various alternative multi-channel transformations can be used to combine input channel signals into coding channels for the joint channel coding of such other multiple channel signals. By contrast, the audio encoder 300 separately transform encodes the individual channels of a multiple channel input signal in independent channel coding 600 (FIG. 6).

Figure 7:
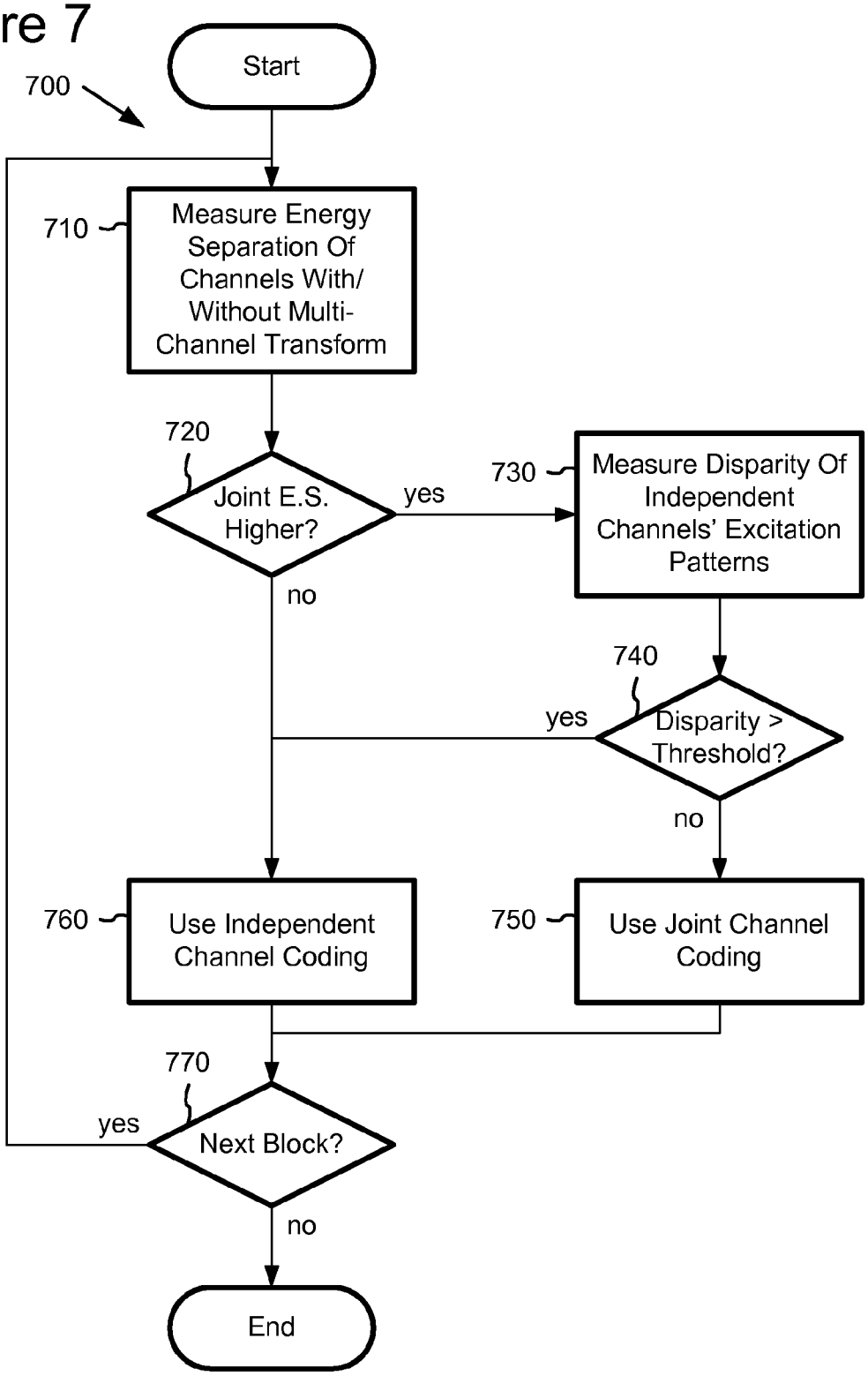
FIG. 7 is a flow chart of a multi-channel coding decision process in the audio encoder of FIG. 3.

FIG. 7 shows one implementation of a multi-channel coding decision process 700 performed in the audio encoder 300 (FIG. 3) to decide the channel coding mode (joint channel coding 500 or independent channel coding 600). In this implementation, the multi-channel coding decision process 700 is an open-loop decision, which generally is less computationally expensive. In this open-loop decision process 700, the decision between channel coding modes is made based on: (a) energy separation between the coding channels, and (b) the disparity between excitation patterns of the individual input channels. This latter basis (excitation pattern disparity) for the multi-channel coding decision is beneficial in audio encoders in which the quantization matrices are forced to be the same for both coding channels when performing joint channel coding. If the aggregate excitation pattern used in generating the quantization matrix is severely mismatched with the excitation patterns of either of the coding channels, then the joint channel coding 500 in such audio encoders would produce a severe coding efficiency penalty. The excitation pattern of the audio signal is discussed in the section below, entitled, "Measuring Audio Quality."

In the illustrated process 700, the audio encoder 300 decides the channel coding mode on a block basis. In other words, the process 700 is performed per input signal block as indicated at decision 770. Alternatively, the channel coding decision can be made on other bases.

At a first action 710 in the process 700, the audio encoder 300 measures the energy separation between the coding channels with and without the multi-channel transformation 510. At decision 720, the audio encoder 300 then determines whether the energy separation of the coding channels with the multi-channel transformation is greater than that without the transformation. In the case of two stereo channels (left and right), the audio encoder can determine the energy is greater with the transformation if the following relation evaluates to true:

$$\frac{\mathrm{Max}(\sigma_l, \sigma_r)}{\mathrm{Min}(\sigma_l, \sigma_r)} < \frac{\mathrm{Max}(\sigma_s, \sigma_d)}{\mathrm{Min}(\sigma_s, \sigma_d)} \tag{8}$$

where $\sigma_l$, $\sigma_r$, $\sigma_s$, and $\sigma_d$, refer to standard deviation in left, right, sum and difference channels, respectively, in either the time or frequency (transform) domain. If either denominator is zero, that corresponding ratio is taken to be a large value, e.g. infinity.

If the energy separation is greater with the multi-channel transformation at decision 720, the audio encoder 300 proceeds to also measure the disparity between excitation patterns of the individual input channels at action 730. In one implementation, the disparity in excitation patterns between the input channels is measured using the following calculation:

$$\mathrm{Max}_b\left\{\frac{E[b]\text{ of left channel}}{E[b]\text{ of right channel}}, \frac{E[b]\text{ of right channel}}{E[b]\text{ of left channel}}\right\} \tag{9}$$

where E[b] refers to the excitation pattern computed for critical band b.

In a second implementation, the audio encoder 300 uses a ratio between the expected noise-to-excitation ratio (NER) of the two input channels as a measure of the disparity. The measurement of NER is discussed in more detail below in the section entitled, "Measuring Audio Quality." For joint coding mode, for a given channel c, the expected NER is given as:

$$NER_{Expected} = \sum_b W[b]\frac{(\tilde{E}[b])^{2\beta}}{E[b]} \tag{10}$$

where $\tilde{E}[b]$ is the aggregate excitation pattern of the input channels at critical band b, E[b] is the excitation pattern of channel c at critical band b, and W[b] is the weighting used in the NER computation described below in the section entitled, "Measuring Audio Quality." In one implementation, based on experimentation, $\beta$=0.25. Alternatively, other calculations measuring disparity in the excitation patterns of the input channels can be used.

At decision 740, the audio encoder compares the measurement of the input channel excitation pattern disparity to a pre-determined threshold. In one implementation example, the threshold rule is that the ratio of the expected NER of the two channels exceeds 2.0, and the smaller expected NER is greater than 0.001. Other threshold values or rules can be used in alternative implementations of the audio encoder.

If the disparity measurement does not exceed the threshold, the audio encoder 300 decides to use joint channel coding 500 (FIG. 5) for the block as indicated at action 750. Otherwise, if the disparity measurement exceeds the threshold, the audio encoder 300 decides against joint channel coding and instead uses independent channel coding 600 (FIG. 6).

The process 700 then continues with the next block of the input signal as indicated at decision 770.

IV. Band Truncation

In audio encoding, a general rule of thumb can be expressed that "coding lower frequencies well" produces better sounding reconstructed audio than "coding all frequencies poorly." The audio encoder 300 (FIG. 3) performs a band truncation process that applies this rule. In this band truncation process, the audio encoder eliminates a few higher frequency coefficients from the transform coefficients that are coded into the compressed audio stream. In other words, the audio encoder zeroes out or otherwise does not code the value of the eliminated transform coefficients. This permits the surviving transform coefficients to be coded at a higher resolution at a given coding bit rate. More specifically, the audio encoder 300 suppresses transform coefficients for frequencies above a cut-off frequency that is a function of the achieved perceptual audio quality (e.g., the NER value calculated as described below in the section entitled, "Measuring Audio Quality").

Figure 8:
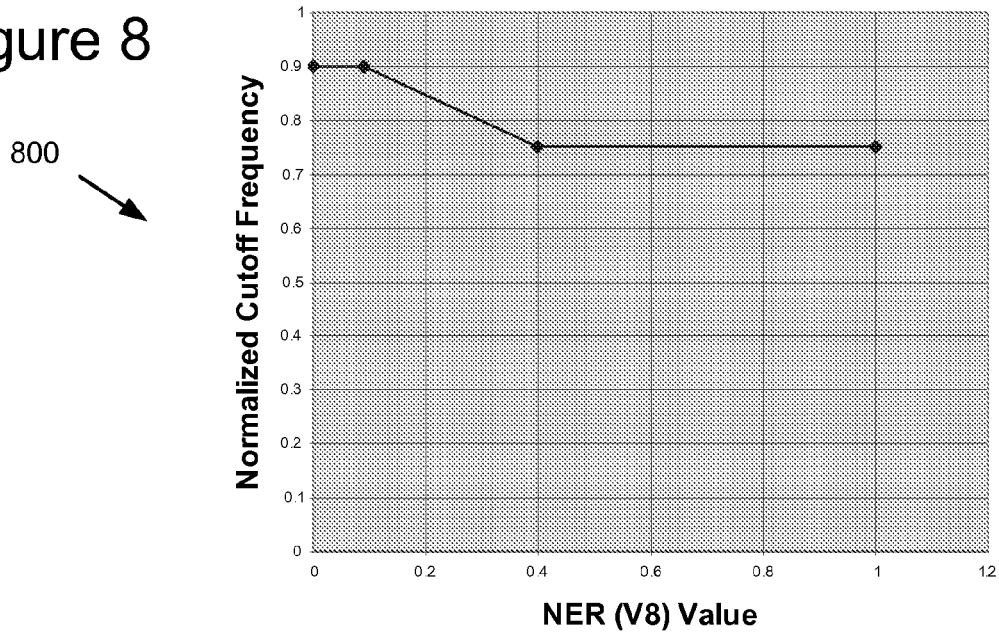
FIG. 8 is a graph of cutoff frequency for band truncation as a function of a perceptual quality measure in the audio encoder of FIG. 3.

FIG. 8 shows a graph 800 of one example of the cut-off frequency of the band truncation process as a function of the achieved NER value, where the cut-off frequency decreases (eliminating more transform coefficients from coding) as the NER value increases. In some audio encoders, the function relating cut-off frequency to NER value is coding mode dependent. Alternatively, various other functions relating the cut-off frequency of band truncation to an achieved quality measurement can be used. In another example, 20% of transform coefficients are truncated if the NER value is greater than or equal to 0.5 for an 8 KHz audio source and 8 Kbps bit rate of compressed audio.

Figure 9:
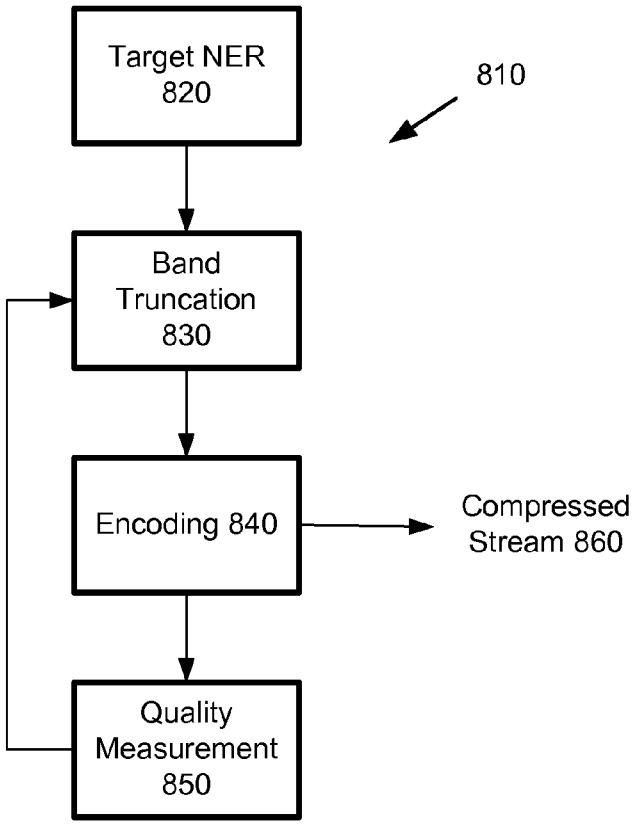
FIG. 9 is a data flow diagram of a pre-encoding band truncation process based on a target quality measure in the audio encoder of FIG. 3.

FIG. 9 shows an improved band truncation process 810 in the audio encoder 300 (FIG. 3). In the improved band truncation process 810, the audio encoder 300 performs a first-pass band truncation as an open-loop computation based on a target NER for the audio signal, then performs a second band truncation as a closed-loop computation based on the achieved NER after compression of the audio signal with the first-pass band truncation.

The improved band truncation process 810 utilizes a combination of audio encoder components, including a target NER setting 820, a band truncation component 830, encoding component 840, and quality measurement component 850. The target NER setting 820 provides the target NER for the audio signal to the band truncation component 830, which then performs the first-pass band truncation on the input audio signal using the cut-off frequency yielded from the target NER by the function shown in the graph 800 of FIG. 8. The encoding component 840 performs encoding and decoding of the first-pass band truncated audio signal as described above with reference to the generalized encoder 300 (FIG. 3) and decoder 400 (FIG. 4), including frequency transform, quantization and inverse transform. The quality measurement component 850 then calculates the achieved NER for the now reconstructed audio signal as described below in the section entitled, "Measuring Audio Quality." The quality measurement component 850 provides feedback of the achieved NER to the band truncation component 830, which then performs the second-pass band truncation on the input audio signal using the cut-off frequency yielded from the achieved NER by the function shown in graph 800. The encoding component then performs final encoding of the input audio signal with the second-pass band truncation to produce the compressed audio signal stream 860. The illustrated improved band truncation process 810 is performed on a block basis on the input audio signal, but alternatively can be performed on other bases.

The improved band truncation process 810 provides the benefit of yielding a more accurate achieved NER quality measure in the audio encoder 300, such as for use in closed-loop band truncation, and multi-channel re-matrixing, among other purposes.

V. Multi-Channel Rematrixing

Figure 10:
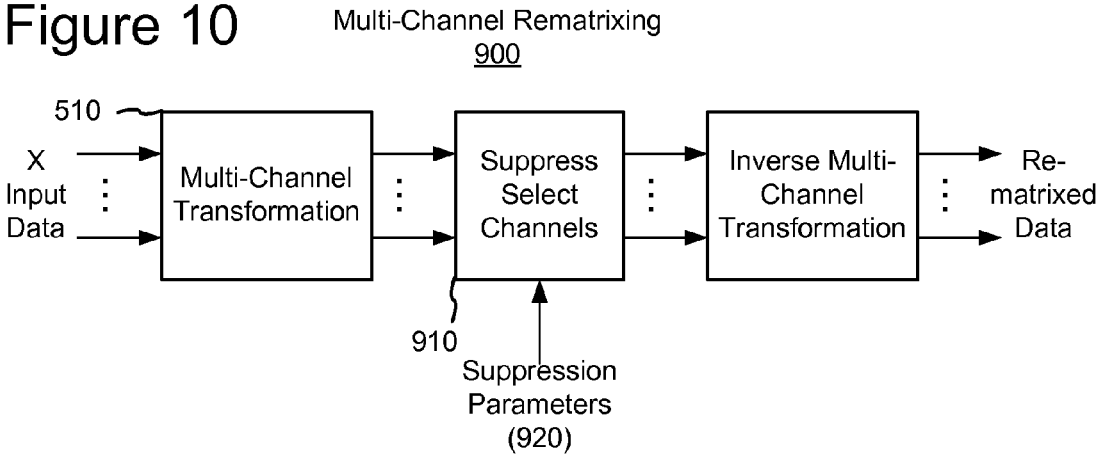
FIG. 10 is a data flow diagram of a multi-channel rematrixing process in the audio encoder of FIG. 3.

FIG. 10 shows a multi-channel rematrixing process 900. When compressing a multi-channel audio signal at very low rates, the distortion (e.g., quantization noise) introduced in each channel can have a significant impact on the "stereo-image" upon play-back. The multi-channel re-matrixing process 900 can reduce the impact of audio compression on the stereo image of a multi-channel audio signal, as well as improve the joint-channel coding efficiency, by selectively suppressing certain coding channels in joint channel coding 500 (FIG. 5).

In one implementation of the multi-channel re-matrixing process 900, the audio encoder 300 (FIG. 3) includes a channel suppressor component 910 following the multi-channel transformation 510. The audio encoder 300 calculates suppression parameters 920 for the multi-channel re-matrixing process 900. Based on the suppression parameters, the channel suppressor component 910 selectively suppresses certain of the coding channels. Upon later application of an inverse multi-channel transformation 930 (e.g., in the audio decoder 400 of FIG. 4 for playback), this multi-channel re-matrixing process 900 produces re-matrixed multi-channel audio data with reduced impact of the distortion from compression on the stereo-image.

In one embodiment, the suppression parameters 920 include a scaling factor (ρ) whose value is based on: (a) current average levels of a perceptual audio quality measure (e.g., the NER described in more detail below in the section entitled, "Measuring Audio Quality"), (b) current rate control buffer fullness, (c) the coding mode (e.g., the bit rate and sample rate settings, etc. of the audio encoder), and (d) the amount of channel separation in the source. More specifically, if the current average level of quality indicates poor reproduction, the value of the scaling factor (ρ) is made much smaller than unity so as to produce severe re-matrixing of the multi-channel audio signal. A similar measure is taken if the rate control buffer is close to being full. On the other hand, if the two channels in the input data are significantly different, the scaling factor (ρ) is made closer to unity, so that little or no re-matrixing takes place.

In the case of two-channel stereo audio signal for example, the audio encoder 300 (FIG. 3) produces the sum and difference coding channels using the equations (6) and (7) with the multi-channel transformation 510 as described above. The coding channel suppression 910 can be described as scaling the difference channel by the scaling factor (ρ) in the following equation:

$$\tilde{x}_d[n]=\rho\cdot x_d[n] \tag{11}$$

The scaling factor (ρ) in this illustrated embodiment for two-channel stereo audio is calculated as follows. If the sample rate is greater than 32 KHz and the bit rate is greater than 32 Kbps, then the scaling factor (ρ) is set equal to 1.0. For other combinations of sample and and bit rates, the audio encoder 300 first calculates the energy separation of the channels. The energy separation of left and right stereo channels is computed as:

$$sep = \frac{\mathrm{Max}(\sigma_l, \sigma_r)}{\mathrm{Min}(\sigma_l, \sigma_r)} \tag{12}$$

whose value is taken as a large quantity (>100) if the denominator is zero.

The audio encoder 300 then determines the scaling factor from the following tables (13-15), dependent on the perceptual quality measure (NER) and coefficient index (B) which are described in more detail below in the section entitled, "Measuring Audio Quality." If (sep<5), the scaling factor (ρ) is given as follows:

$$\rho = \begin{cases} 6/16 & (NER > 2) \text{ OR } (B_F > 0.9) \\ 7/16 & (NER > 1.75) \text{ OR } (B_F > 0.9) \\ 8/16 & (NER > 1.5) \text{ OR } (B_F > 0.85) \\ 9/16 & (NER > 1.25) \text{ OR } (B_F > 0.85) \\ 10/16 & (NER > 1.0) \text{ OR } (B_F > 0.85) \\ 11/16 & (NER > 0.75) \text{ OR } (B_F > 0.8) \\ 12/16 & (NER > 0.5) \text{ OR } (B_F > 0.75) \\ 13/16 & (NER > 0.25) \\ 14/16 & (NER > 0.1) \\ 16/16 & \text{Otherwise} \end{cases} \tag{13}$$

If (5≦sep<100), the scaling factor (ρ) is given as follows:

$$\rho = \begin{cases} 8/16 & (NER > 2.5) \text{ OR } (B_F > 0.95) \\ 9/16 & (NER > 2.25) \text{ OR } (B_F > 0.9) \\ 10/16 & (NER > 2) \text{ OR } (B_F > 0.9) \\ 10/16 & (NER > 1.75) \text{ OR } (B_F > 0.9) \\ 11/16 & (NER > 1.5) \text{ OR } (B_F > 0.85) \\ 11/16 & (NER > 1.25) \text{ OR } (B_F > 0.85) \\ 12/16 & (NER > 1.0) \text{ OR } (B_F > 0.85) \\ 13/16 & (NER > 0.75) \text{ OR } (B_F > 0.8) \\ 14/16 & (NER > 0.5) \text{ OR } (B_F > 0.75) \\ 15/16 & (NER > 0.25) \\ 16/16 & \text{Otherwise} \end{cases} \tag{14}$$

If (100≦sep), the scaling factor (ρ) is given as follows:

$$\rho = \begin{cases} 12/16 & (NER > 2.5) \text{ OR } (B_F > 0.95) \\ 12/16 & (NER > 2.25) \text{ OR } (B_F > 0.9) \\ 13/16 & (NER > 2.0) \text{ OR } (B_F > 0.9) \\ 13/16 & (NER > 1.75) \text{ OR } (B_F > 0.9) \\ 14/16 & (NER > 1.5) \text{ OR } (B_F > 0.85) \\ 14/16 & (NER > 1.25) \text{ OR } (B_F > 0.85) \\ 15/16 & (NER > 1.0) \text{ OR } (B_F > 0.85) \\ 15/16 & (NER > 0.75) \text{ OR } (B_F > 0.8) \\ 15/16 & (NER > 0.5) \text{ OR } (B_F > 0.75) \\ 16/16 & \text{Otherwise} \end{cases} \quad (15)$$

Finally, the-matrixed channels can then be obtained (e.g., in the inverse multi-channel information 930) through the following equations:

$$\tilde{x}_l[n]=x_s[n]+\tilde{x}_d[n] \quad (16)$$

$$\tilde{x}_l[n]=x_s[n]-\tilde{x}_d[n] \quad (17)$$

VI. Quantizer Step-Size Modification For Header Reduction

Figure 11:
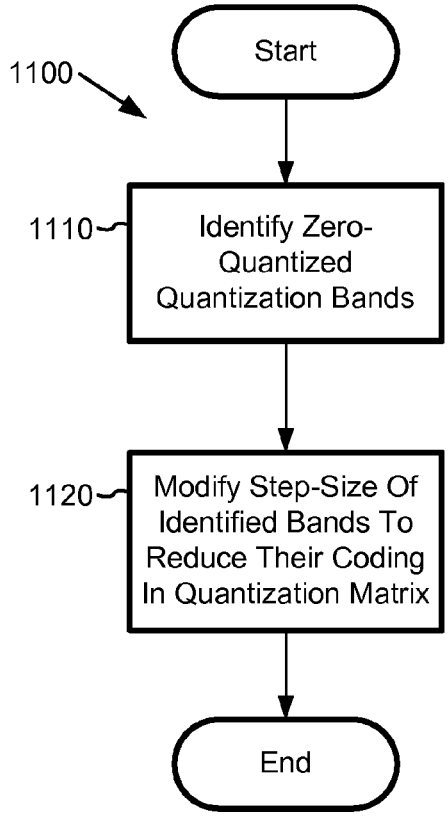
FIG. 11 is a flow chart of a quantization step-size modification process for header bit reduction in the audio encoder of FIG. 3.

FIG. 11 shows a header reduction process 1100 to further improve coding efficiency in the audio encoder 300 (FIG. 3). In the audio encoder 300, a quantization matrix containing quantizer step size information for each quantization band of each coding channel is normally sent for every frame of coded data in the compressed audio data stream. These quantization matrices are differentially encoded (e.g., similar to differential pulse code modulation) in a header of each frame within the compressed audio stream produced by the audio encoder. The quantization matrix is described in further detail in the related patent application, entitled "Quantization Matrices For Digital Audio," which is incorporated herein by reference above.

Generally at lower coding rates, the audio encoder 300 quantizes certain quantization band coefficients to all zeroes, such as due to quantization or due to the band truncation process described above. In such case, the quantization step size for the zeroed quantization band is not needed by the decoder to decode the compressed audio signal stream.

The header reduction process 1100 reduces the size of the header by selectively modifying the quantization step size of quantization band coefficients that are quantized, so that such quantization step sizes will differentially encode using fewer bits in the header. More specifically, at action 1110 in the header reduction process 1100, the audio encoder 300 identifies which quantization bands are quantized to zero, either due to band truncation or because the value of the coefficient for that band is sufficiently small to quantize to zero. At action 1120, the audio encoder 300 modifies the quantization step size of the identified quantization bands to values that will be encoded in fewer bits in the header.

Figure 12:
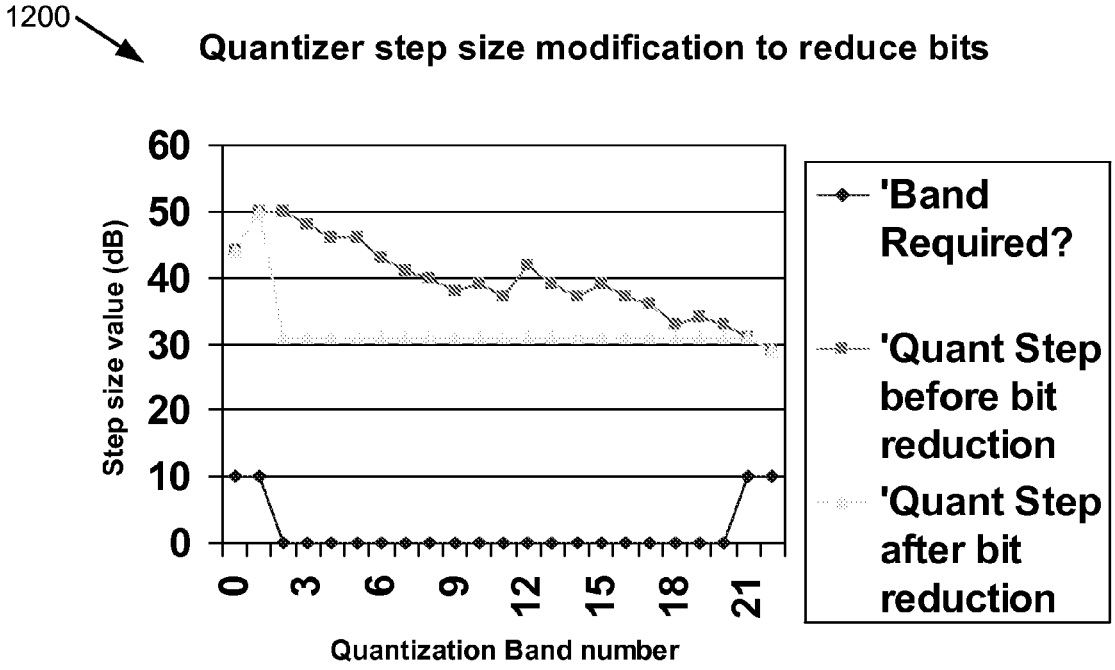
FIG. 12 is a graph of an example of quantization step-size modification to reduce header bits.

FIG. 12 shows a graph 1200 of an example of quantization step-size modification for header reduction via the header reduction process 1100. The values of the original quantization step sizes of the quantization bands for this frame of the audio signal is shown by the line labeled "quant. step before bit reduction" in graph 1200. In this example, quantization bands numbered 2 through 20 are quantized to zero (as indicated by the "band required" line of the graph 1200). The header reduction process 1100 therefore modifies the quantization step sizes for these bands to values (e.g., the value of quantization band numbered 21 in this example) that will be differentially encoded in the header using fewer bits. The modified values are depicted in the graph 1200 by the line labeled "quant. step after bit reduction." The particular modification of the quantization step sizes that will yield fewer bits in the header is dependent on the particular form of encoding used. Accordingly, the header reduction process 1100 modifies the value of the quantization step sizes of the zeroed quantization band coefficients to a value that will encode in fewer bits for the particular form of quantization step encoding employed by the audio encoder (whether differential encoding or otherwise).

V. Measuring Audio Quality

Figure 13:
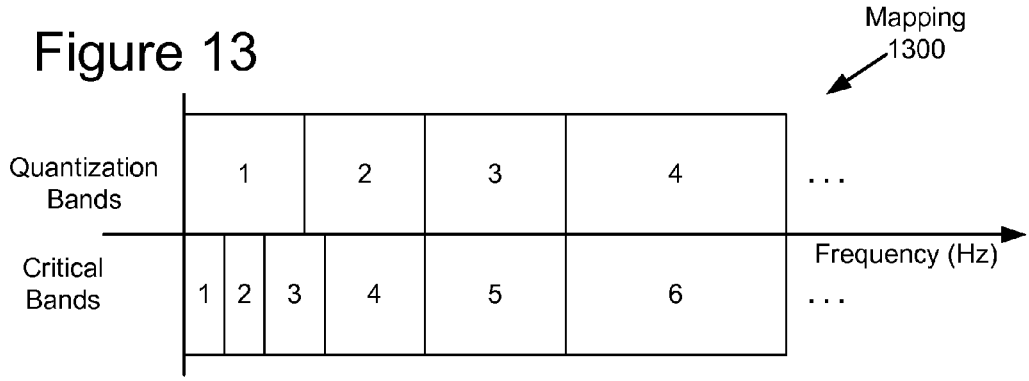
FIG. 13 is a chart showing a mapping of quantization bands to critical bands according to the illustrative embodiment.

FIG. 13 shows an example of a mapping (1300) between quantization bands and critical bands. The critical bands are determined by an auditory model, while the quantization bands are determined by the encoder for efficient representation of the quantization matrix. The number of quantization bands can be different (typically less) than the number of critical bands, and the band boundaries can be different as well in one implementation, the number of quantization bands relates to block size. For a block of 2048 frequency coefficients, the number of quantization bands is 25, and each quantization band maps to one of 25 critical bands of the same frequency range. For a block of the 64 frequency coefficients, the number of quantization bands is 13, and some quantization bands map to multiple critical bands.

Figure 14A:
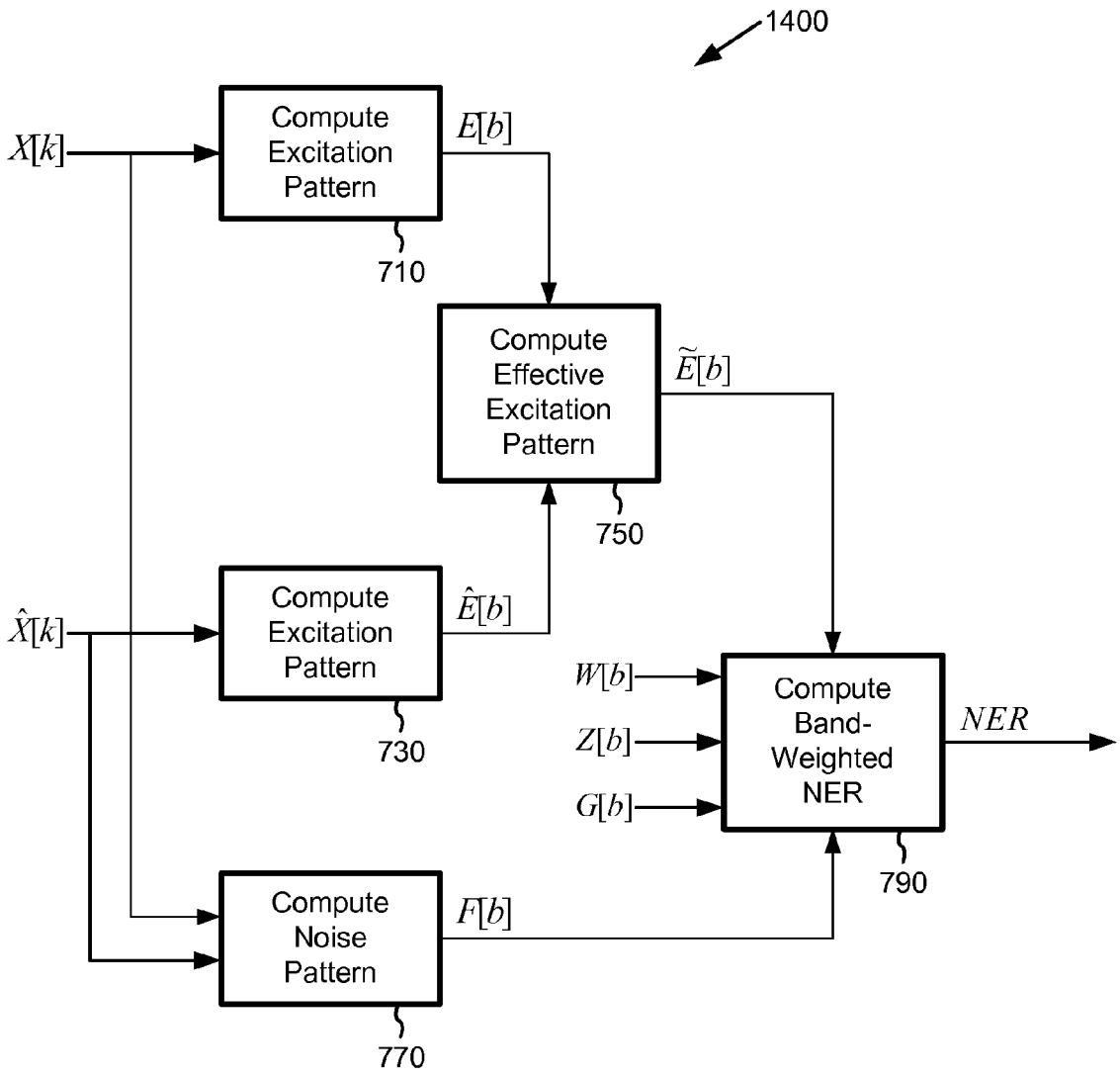
FIGS. 14*a*-14*d* are diagrams showing computation of NER in an audio encoder according to the illustrative embodiment.
Figure 14B:
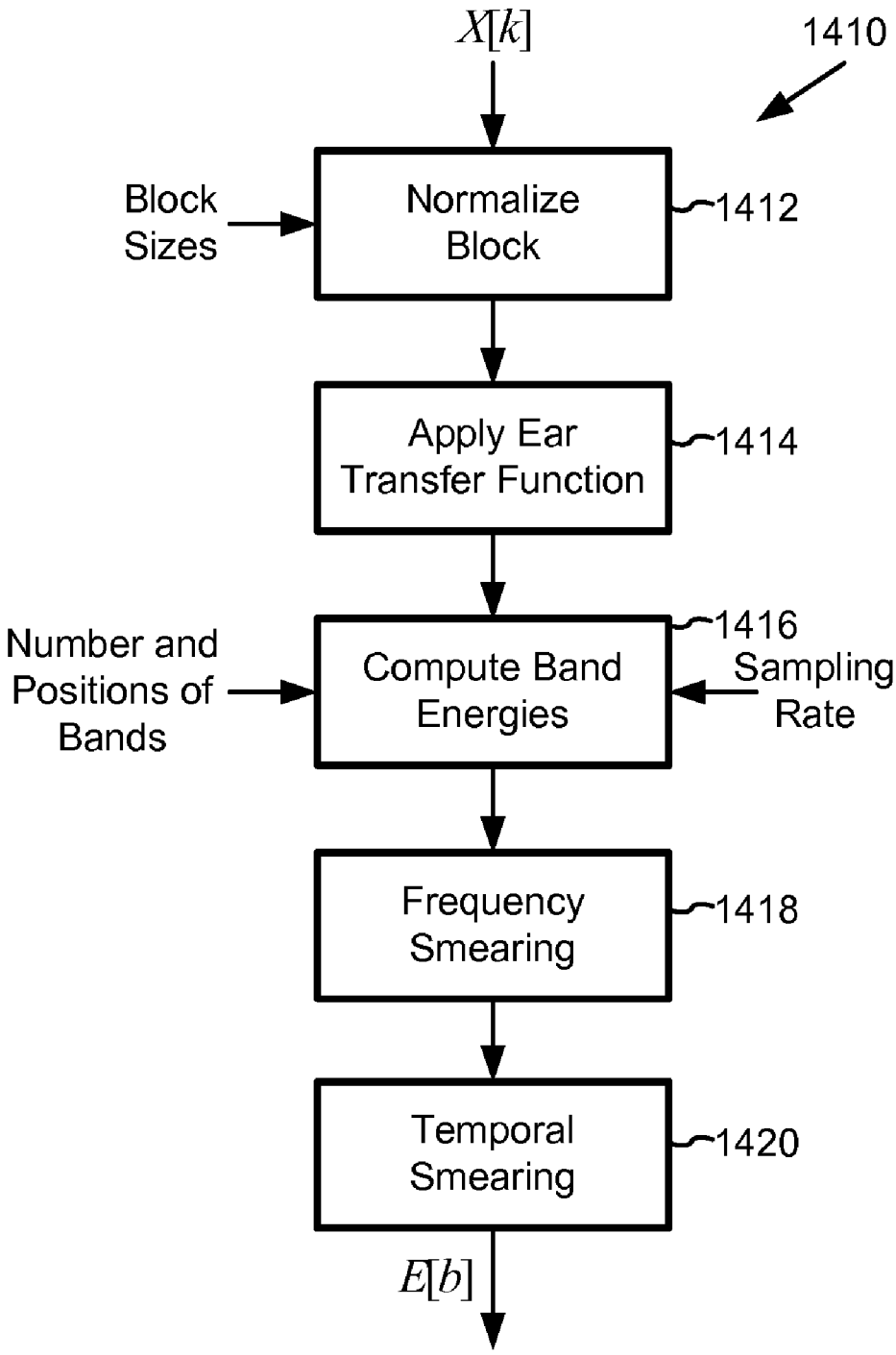
Figure 14C:
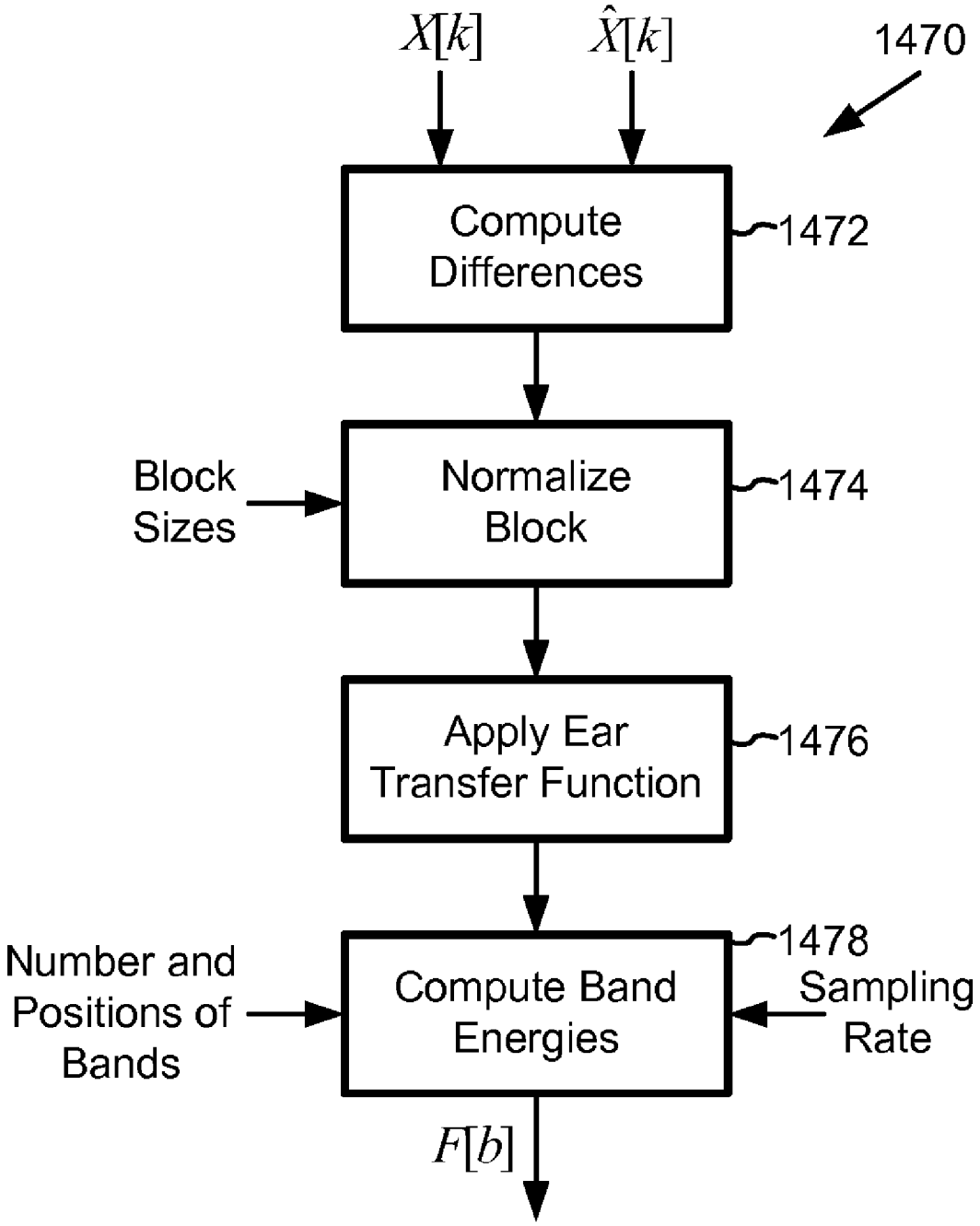
Figure 14D:
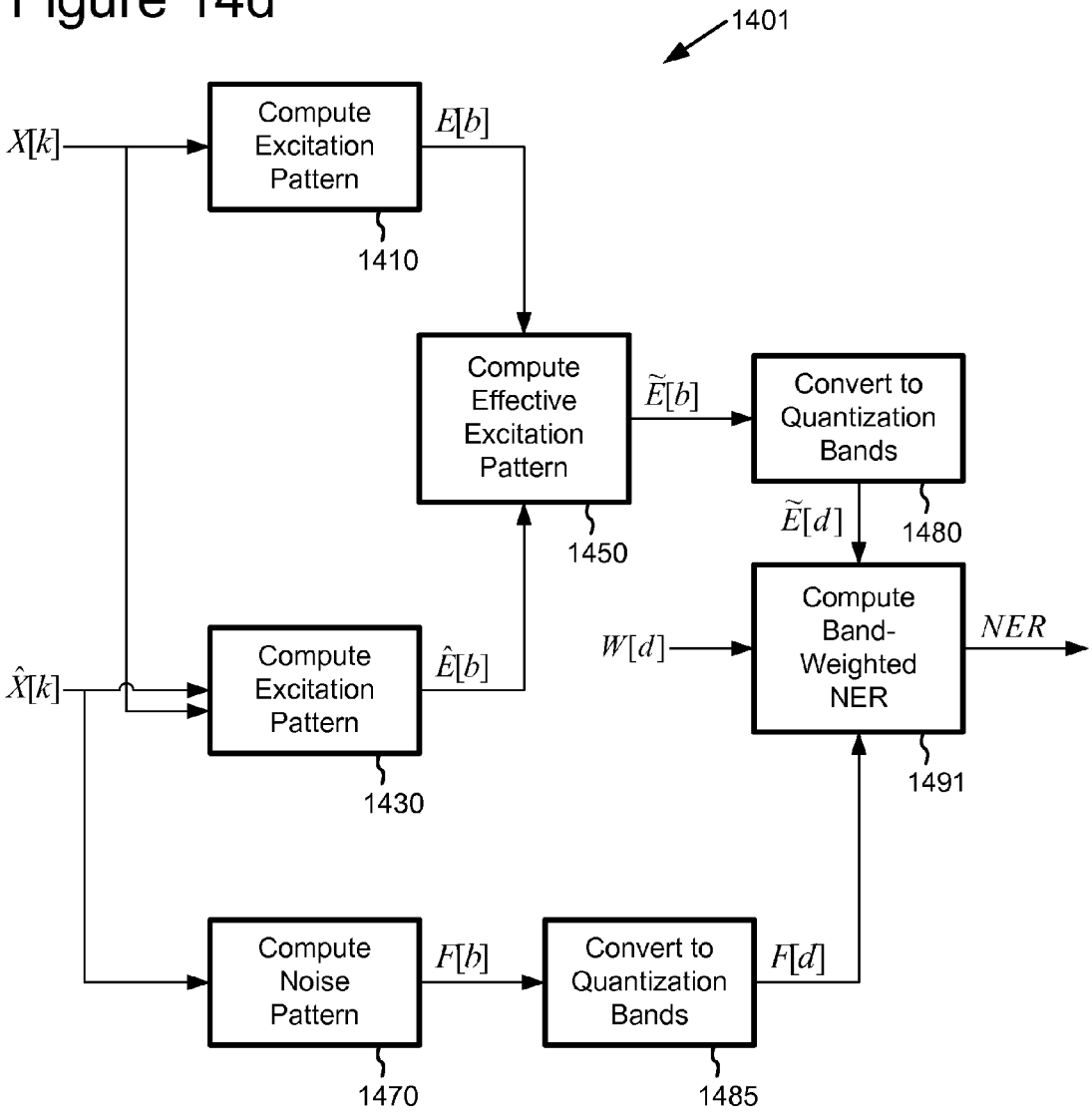

FIGS. 14*a*-14*d* show techniques for computing one particular type of quality measure—Noise to Excitation Ratio ["NER"]. FIG. 14*a* shows a technique (1400) for computing NER of a block by critical bands for a single channel. The overall quality measure for the block is a weighted sum of NER s of individual critical bands. FIGS. 14*b* and 14*c* show additional detail for several stages of the technique (1400). FIG. 14*d* shows a technique (701) for computing NER of a block by quantization bands.

The inputs to the techniques (1400) and (1401) include the original frequency coefficients X[k] for the block, the reconstructed coefficients $\hat{X}[k]$ (inverse quantized, inverse weighted, and inverse multi-channel transformed if needed), and one or more weight arrays. The one or more weight arrays can indicate 1) the relative importance of different bands to perception, 2) whether bands are truncated, and/or 3) whether bands are noise-substituted. The one or more weight arrays can be in separate arrays (e.g., W[b], Z[b], G[b]), in a single aggregate array, or in some other combination. FIGS. 14*b* and 14*c* show other inputs such as transform block size (i.e., current window/sub-frame size), maximum block size (i.e., largest time window/frame size), sampling rate, and the number and positions of critical bands.

A. Computing Excitation Patterns

With reference to FIG. 14*a*, the encoder computes (1410) the excitation pattern E[b] for the original frequency coefficients X[k] and computes (1430) the excitation pattern $\hat{E}[b]$ for the reconstructed frequency coefficients $\hat{X}[k]$ for a block of audio information. The encoder computes the excitations pattern $\hat{E}[b]$ with the same coefficients that are used in compression, using the sampling rate and block sizes used in compression, which makes the process more flexible than the process for computing excitation patterns described in ITU-R BS 1387. In addition, several steps from ITU-R BS 1387 are eliminated (e.g., the adding of internal noise) or simplified to reduce complexity with only a little loss of accuracy.

FIG. 14*b* shows in greater detail the stage of computing (1410) the excitation pattern E[b] for the original frequency coefficients X[k] in a variable-size transform block. To compute (1430) $\hat{E}[b]$, the input is $\hat{X}[k]$ instead of X[k], and the process is analogous.

First, the encoder normalizes (1412) the block of frequency coefficients X[k],0≦k< (subframe_size/2) for a sub-frame, taking as inputs the current sub-frame size and the maximum sub-frame size (if not pre-determined in the encoder). The encoder normalizes the size of the block to a standard size by interpolating values between frequency coefficients up to the largest time window/sub-frame size. For example, the encoder uses a zero-order hold technique (i.e., coefficient repetition):

$$Y[k]=\alpha X[k'] \quad (18),$$

$$k' = \text{floor}\left(\frac{k}{\rho}\right), \quad (19)$$

$$\rho = \frac{\text{max_subframe_size}}{\text{subframe_size}}, \quad (20)$$

where Y[k] is the normalized block with interpolated frequency coefficient values, α is an amplitude scaling factor described below, and k' is an index in the block of frequency coefficients. The index k' depends on the interpolation factor ρ, which is the ratio of the largest sub-frame size to the current sub-frame size. If the current sub-frame size is 1024 coefficients and the maximum size is 4096 coefficients, ρ is 4, and for every coefficient from 0-511 in the current transform block (which has a size of 0≦k< (subframe_size/2)), the normalized block Y[k] includes four consecutive values. Alternatively, the encoder uses other linear or non-linear interpolation techniques to normalize block size.

The scaling factor a compensates for changes in amplitude scale that relate to sub-frame size. In one implementation, the scaling factor is:

$$\alpha = \frac{c}{\text{subframe_size}}, \quad (21)$$

where c is a constant with a value determined experimentally, for example, c=1.0. Alternatively, other scaling factors can be used to normalize block amplitude scale.

Figure 15:
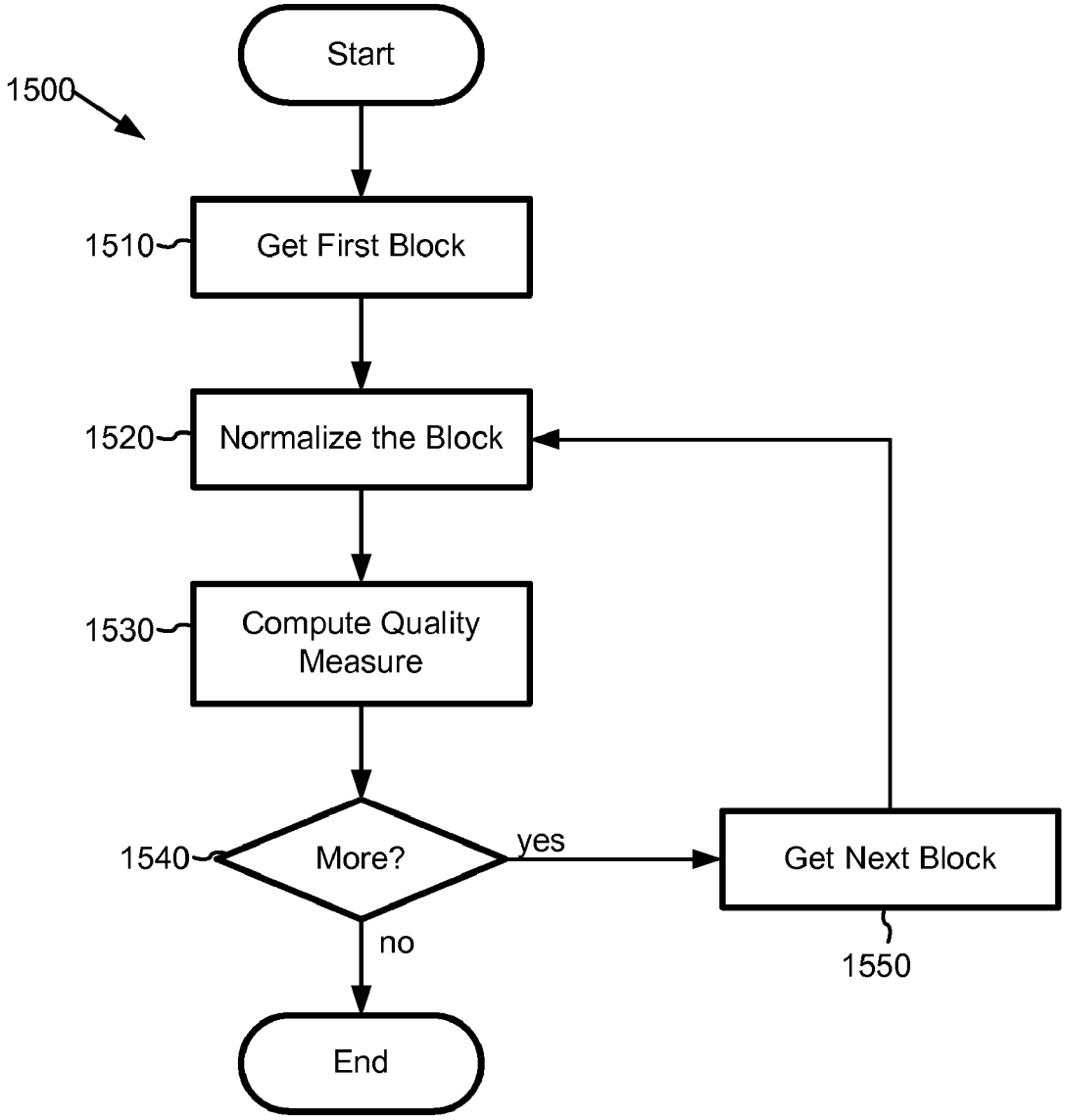
FIG. 15 is a flowchart showing a technique for measuring the quality of a normalized block of audio information according to the illustrative embodiment.

FIG. 15 shows a technique (1500) for measuring the audio quality of normalized, variable-size blocks in a broader context than FIGS. 14*a* through 14*d*. A tool such as an audio encoder gets (1510) a first variable-size block and normalizes (1520) the variable-size block. The variable-size block is, for example, a variable-size transform block of frequency coefficients. The normalization can include block size normalization as well as amplitude scale normalization, and enables comparisons and operations between different variable-size blocks.

Next, the tool computes (1530) a quality measure for the normalized block. For example, the tool computes NER for the block.

If the tool determines (1540) that there are no more blocks to measure quality for, the technique ends. Otherwise, the tool gets (1550) the next block and repeats the process. For the sake of simplicity, FIG. 15 does not show repeated computation of the quality measure (as in a quantization loop) or other ways in which the technique (1500) can be used in conjunction with other techniques.

Returning to FIG. 14*b*, after normalizing (1412) the block, the encoder optionally applies (1414) an outer/middle ear transfer function to the normalized block.

$$Y[k]\leftarrow A[k]\cdot Y[k] \quad (22).$$

Figure 16:
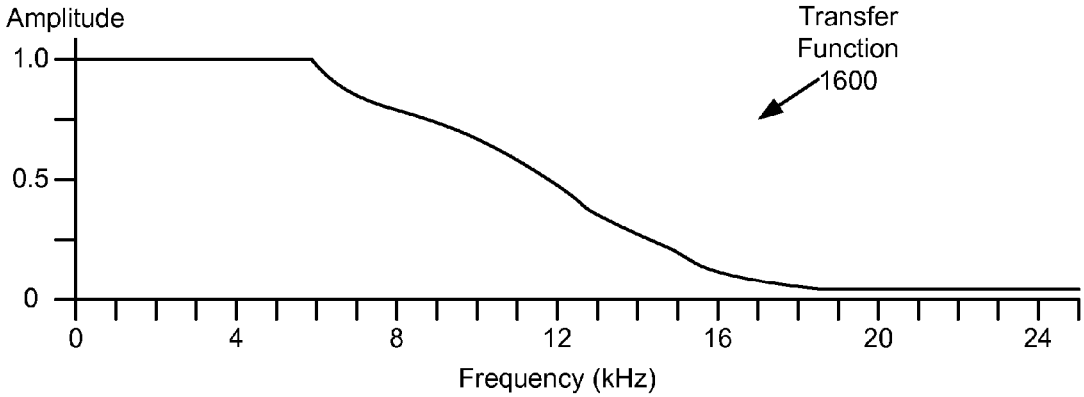
FIG. 16 is a graph of an outer/middle ear transfer function according to the illustrative embodiment.

Modeling the effects of the outer and middle ear on perception, the function A[k] generally preserves coefficients at lower and middle frequencies and attenuates coefficients at higher frequencies. FIG. 16 shows an example of a transfer function (1600) used in one implementation. Alternatively, a transfer function of another shape is used. The application of the transfer function is optional. In particular, for high bit rate applications, the encoder preserves fidelity at higher frequencies by not applying the transfer function.

The encoder next computes (1416) the band energies for the block, taking as inputs the normalized block of frequency coefficients Y[k], the number and positions of the bands, the maximum sub-frame size, and the sampling rate. (Alternatively, one or more of the band inputs, size, or sampling rate is predetermined.) Using the normalized block Y[k], the energy within each critical band b is accumulated:

$$E[b] = \sum_{k\in B[b]} Y^2[k], \quad (23)$$

where B[b] is a set of coefficient indices that represent frequencies within critical band b. For example, if the critical band b spans the frequency range $[f_l, f_h)$, the set B[b] can be given as:

$$B[b] = \left\{ \begin{array}{c} k \mid k \cdot \dfrac{samplingrate}{\text{max_subframe_size}} \geq f_l \text{ AND} \\ k \cdot \dfrac{samplingrate}{\text{max_subframe_size}} < f_h \end{array} \right\}. \quad (24)$$

So, if the sampling rate is 44.1 kHz and the maximum sub-frame size is 4096 samples, the coefficient indices 38 through 47 (of 0 to 2047) fall within a critical band that runs from 400 up to but not including 510. The frequency ranges $[f_l, f_h)$ for the critical bands are implementation-dependent, and numerous options are well known. For example, see ITU-R BS 1387, the MP3 standard, or references mentioned therein.

Next, also in optional stages, the encoder smears the energies of the critical bands in frequency smearing (1418) between critical bands in the block and temporal smearing (1420) from block to block. The normalization of block sizes facilitates and simplifies temporal smearing between variable-size transform blocks. The frequency smearing (1418) and temporal smearing (1420) are also implementation-dependent, and numerous options are well known. For example, see ITU-R BS 1387, the MP3 standard, or references mentioned therein. The encoder outputs the excitation pattern E[b] for the block.

Alternatively, the encoder uses another technique to measure the excitation of the critical bands of the block.

B. Computing Effective Excitation Pattern

Returning to FIG. 14*a*, from the excitation patterns E[b] and Ê[b] for the original and the reconstructed frequency coefficients, respectively, the encoder computes (1450) an effective excitation pattern Ẽ[b]. For example, the encoder finds the minimum excitation on a band by band basis between E[b] and Ê[b]:

$$\tilde{E}[b]=\text{Min}(E[b],\hat{E}[b]) \quad (25).$$

Alternatively the encoder uses another formula to determine the effective excitation pattern. Excitation in the reconstructed signal can be more than or less the excitation in the original signal due to the effects of quantization. Using the effective excitation pattern $\tilde{E}[b]$ rather than the excitation pattern E[b] for the original signal ensures that the masking component is present at reconstruction. For example, if the original frequency coefficients in a band are heavily quantized, the masking component that is supposed to be in that band might not be present in the reconstructed signal, making noise audible rather than inaudible. On the other hand, if the excitation at a band in the reconstructed signal is much greater than the excitation at that band in the original signal, the excess excitation in the reconstructed signal may itself be due to noise, and should not be factored into later NER calculations.

Figure 17:
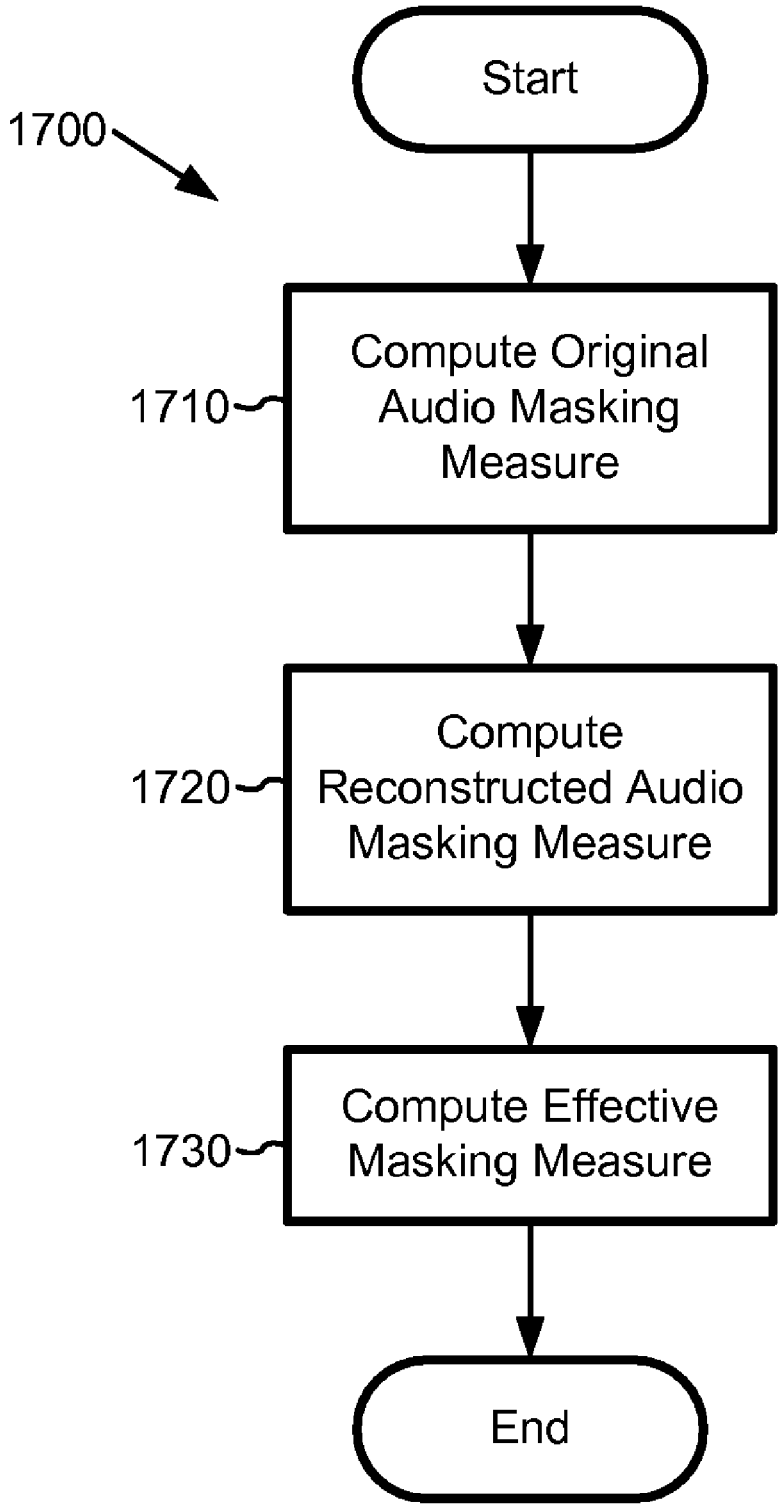
FIG. 17 is a flowchart showing a technique for computing an effective masking measure according to the illustrative embodiment.

FIG. 17 shows a technique (1700) for computing an effective masking measure in a broader context than FIGS. 7*a* through 7*d*. A tool such as an audio encoder computes (1710) an original audio masking measure. For example, the tool computes an excitation pattern for a block of original frequency coefficients.

Alternatively, the tool computes another type of masking measure (e.g., masking threshold), measures something other than blocks (e.g., channels, entire signals), and/or measures another type of information.

The tool computes (1720) a reconstructed audio masking measure of the same general format as the original audio masking measure.

Next, the tool computes (1730) an effective masking measure based at least in part upon the original audio masking measure and the reconstructed audio masking measure. For example, the tool finds the minimum of two excitation patterns. Alternatively, the tool uses another technique to determine the effective excitation masking measure. For the sake of simplicity, FIG. 17 does not show repeated computation of the effective masking measure (as in a quantization loop) or other ways in which the technique (1700) can be used in conjunction with other techniques.

C. Computing Noise Pattern

Returning to FIG. 14*a*, the encoder computes (1470) the noise pattern F[b] from the difference between the original frequency coefficients and the reconstructed frequency coefficients. Alternatively, the encoder computes the noise pattern F[b] from the difference between time series of original and reconstructed audio samples. The computing of the noise pattern F[b] uses some of the steps used in computing excitation patterns. FIG. 14*c* shows in greater detail the stage of computing (1470) the noise pattern F[b].

First, the encoder computes (1472) the differences between a block of original frequency coefficients X[k] and a block of reconstructed frequency coefficients $\hat{X}[k]$ for $0 \leqq k <$ (sub-frame_size/2). The encoder normalizes (1474) the block of differences, taking as inputs the current sub-frame size and the maximum sub-frame size (if not pre-determined in the encoder). The encoder normalizes the size of the block to a standard size by interpolating values between frequency coefficients up to the largest time window/sub-frame size. For example, the encoder uses a zero-order hold technique (i.e., coefficient repetition):

$$DY[k]=\alpha(X[k']-\hat{X}[k']) \quad (26),$$

where DY[k] is the normalized block of interpolated frequency coefficient differences, $\alpha$ is an amplitude scaling factor described in Equation (10), and k' is an index in the sub-frame block described in Equation (8). Alternatively, the encoder uses other techniques to normalize the block.

After normalizing (1474) the block, the encoder optionally applies (1476) an outer/middle ear transfer function to the normalized block.

$$DY[k] \leftarrow A[k] \cdot DY[k] \quad (27),$$

where A[k] is a transfer function as shown, for example, in FIG. 16.

The encoder next computes (1478) the band energies for the block, taking as inputs the normalized block of frequency coefficient differences DY[k], the number and positions of the bands, the maximum sub-frame size, and the sampling rate. (Alternatively, one or more of the band inputs, size, or sampling rate is predetermined.) Using the normalized block of frequency coefficient differences DY[k], the energy within each critical band b is accumulated:

$$F[b] = \sum_{k \in B[b]} DY^2[k], \quad (28)$$

where B[b] is a set of coefficient indices that represent frequencies within critical band b as described in Equation 13. As the noise pattern F[b] represents a masked signal rather than a masking signal, the encoder does not smear the noise patterns of critical bands for simultaneous or temporal masking.

Alternatively, the encoder uses another technique to measure noise in the critical bands of the block.

D. Band Weights

Before computing NER for a block, the encoder determines one or more sets of band weights for NER of the block. For the bands of the block, the band weights indicate perceptual weightings, which bands are noise-substituted, which bands are truncated, and/or other weighting factors. The different sets of band weights can be represented in separate arrays (e.g., W[b], G[b], and Z[b]), assimilated into a single array of weights, or combined in other ways. The band weights can vary from block to block in terms of weight amplitudes and/or numbers of band weights.

Figure 18:
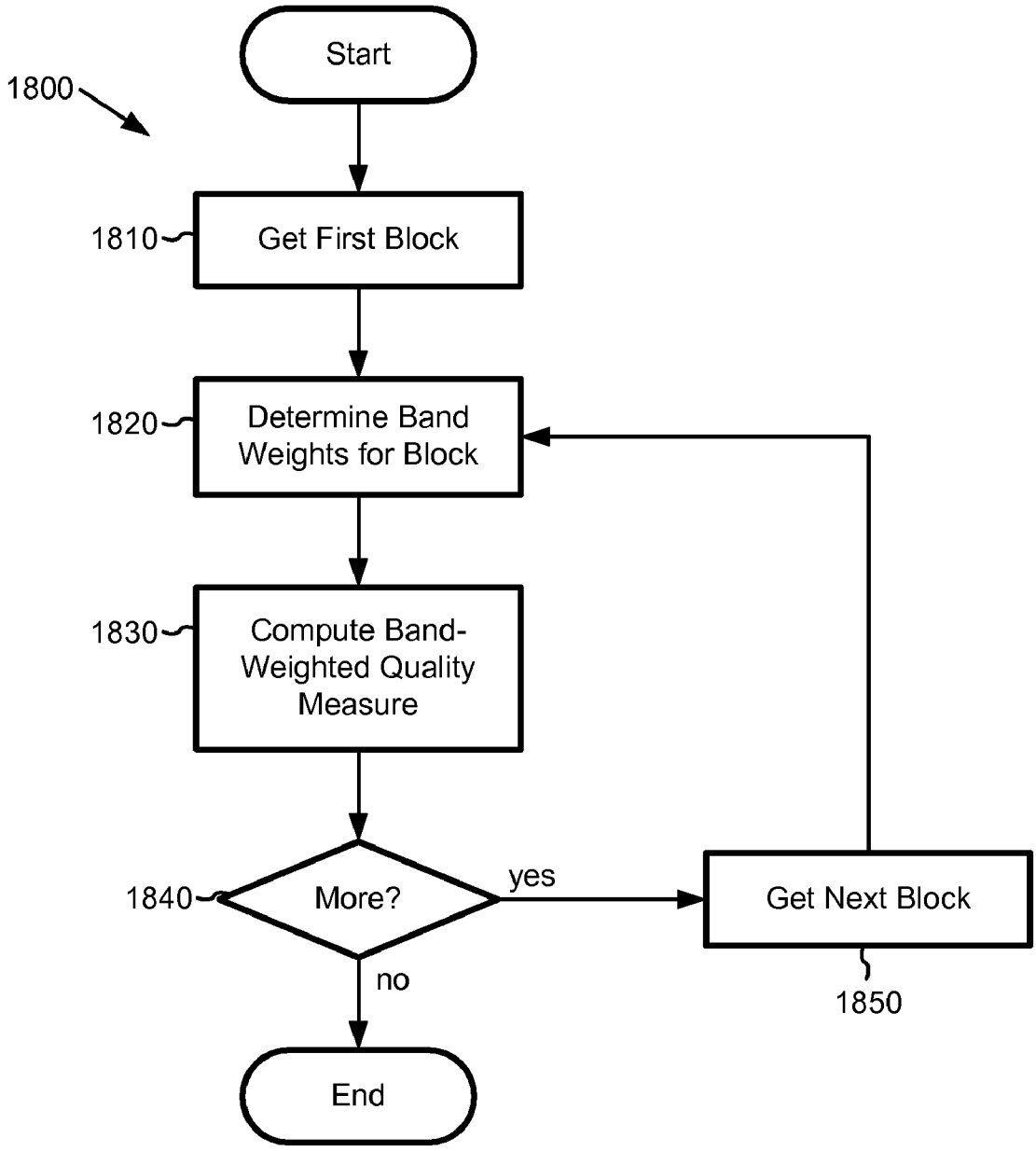
FIG. 18 is a flowchart showing a technique for computing a band-weighted quality measure according to the illustrative embodiment.

FIG. 18 shows a technique (1800) for computing a band-weighted quality measure for a block in a broader context than FIGS. 14*a* through 14*d*. A tool such as an audio encoder gets (1810) a first block of spectral information and determines (1820) band weights for the block. For example, the tool computes a set of perceptual weights, a set of weights indicating which bands are noise-substituted, a set of weights indicating which bands are truncated, and/or another set of weights for another weighting factor. Alternatively, the tool receives the band weights from another module. Within an encoding session, the band weights for one block can be different than the band weights for another block in terms of the weights themselves or the number of bands.

The tool then computes (1830) a band-weighted quality measure. For example, the tool computes a band-weighted NER. The tool determines (1840) if there are more blocks. If so, the tool gets (1850) the next block and determines (1820) band weights for the next block. For the sake of simplicity, FIG. 18 does not show different ways to combine sets of band weights, repeated computation of the quality measure for the block (as in a quantization loop), or other ways in which the technique (1800) can be used in conjunction with other techniques.

1. Perceptual Weights

Figure 19:
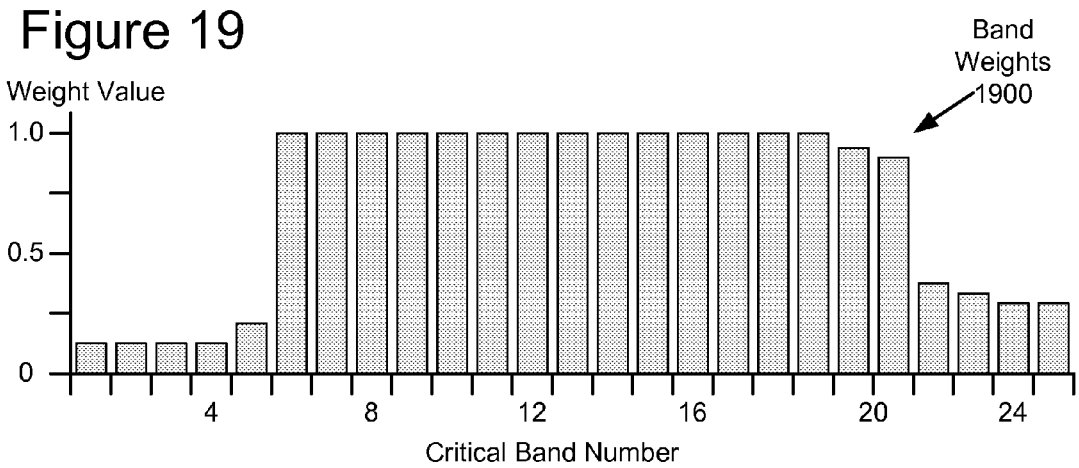
FIG. 19 is a graph showing a set of perceptual weights for critical band according to the illustrative embodiment.

With reference to FIG. 14*a*, a perceptual weight array W[b] accounts for the relative importance of different bands to the perceived quality of the reconstructed audio. In general, bands for middle frequencies are more important to perceived quality than bands for low or high frequencies. FIG. 19 shows an example of a set of perceptual weights (1900) for critical bands for NER computation. The middle critical bands are given higher weights than the lower and higher critical bands.

The perceptual weight array W[b] can vary in terms of amplitudes from block to block within an encoding session; the weights can be different for different patterns of audio information (e.g., different excitation patterns), different applications (e.g., speech coding, music coding), different sampling rates (e.g., 8 kHz, 96 kHz), different bitrates of coding, or different levels of audibility of target listeners (e.g., playback at 40 dB, 96 dB). The perceptual weight array W[b] can also change in response to user input (e.g., a user adjusting weights based on the user's preferences).

2. Noise Substitution

In one implementation, the encoder can use noise substitution (rather than quantization of spectral information) to parametrically convey audio information for a band in low and mid-bit rate coding. The encoder considers the audio pattern (e.g., harmonic, tonal) in deciding whether noise substitution is more efficient than sending quantized spectral information. Typically, the encoder starts using noise substitution for higher bands and does not use noise substitution at all for certain bands. When the generated noise pattern for a band is combined with other audio information to reconstruct audio samples, the audibility of the noise is comparable to the audibility of the noise associated with an actual noise pattern.

Generated noise patterns may not integrate well with quality measurement techniques designed for use with actual noise and signal patterns, however. Using a generated noise pattern for a completely or partially noise-substituted band, NER or another quality measure may inaccurately estimate the audibility of noise at that band.

For this reason, the encoder of FIG. 14*a* does not factor the generated noise patterns of the noise-substituted bands into the NER. The array G[b] indicates which critical bands are noise-substituted in the block with a weight of 1 for each noise-substituted band and a weight of 0 for each other band. The encoder uses the array G[b] to skip noise-substituted bands when computing NER. Alternatively, the array G[b] includes a weight of 0 for noise-substituted bands and 1 for all other bands, and the encoder multiplies the NER by the weight 0 for noise-substituted bands; or, the encoder uses another technique to account for noise substitution in quality measurement.

An encoder typically uses noise substitution with respect to quantization bands. The encoder of FIG. 14*a* measures quality for critical bands, however, so the encoder maps noise-substituted quantization bands to critical bands. For example, suppose the spectrum of noise-substituted quantization band d overlaps (partially or completely) the spectrum of critical bands $b_{lowd}$ through $b_{highd}$. The entries $G[b_{lowd}]$ through $G[b_{highd}]$ are set to indicate noise-substituted bands. Alternatively, the encoder uses another linear or non-linear technique to map noise-substituted quantization bands to critical bands.

For multi-channel audio, the encoder computes NER for each channel separately. If the multi-channel audio is in independently coded channels, the encoder can use a different array G[b] for each channel. On the other hand, if the multi-channel audio is in jointly coded channels, the encoder uses an identical array G[b] for all reconstructed channels that are jointly coded. If any of the jointly coded channels has a noise-substituted band, when the jointly coded channels are transformed into independently coded channels, each independently coded channel will have noise from the generated noise pattern for that band. Accordingly, the encoder uses the same array G[b] for all reconstructed channels, and the encoder includes fewer arrays G[b] in the output bitstream, lowering overall bit rate.

Figure 20:
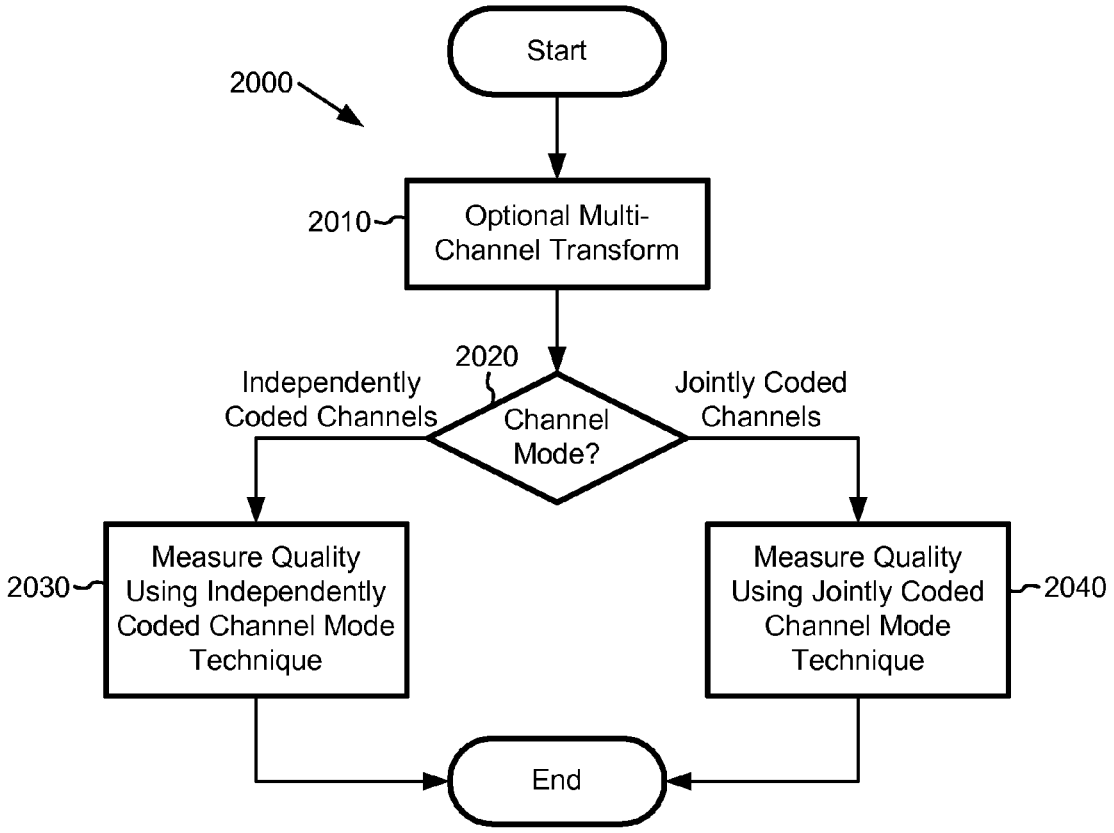
FIG. 20 is a flowchart showing a technique for measuring audio quality in a coding channel mode-dependent manner according to the illustrative embodiment.

More generally, FIG. 20 shows a technique (2000) for measuring audio quality in a channel mode-dependent manner. A tool such as an audio encoder optionally applies (2010) a multi-channel transform to multi-channel audio. For example, a tool that works with stereo mode audio optionally outputs the stereo audio in independently coded channels or in jointly coded channels.

The tool determines (2020) the channel mode of the multi-channel audio and then measures quality in a channel mode-dependent manner. If the audio is in independently coded channels, the tool measures (2030) quality using a technique for independently coded channels, and if the audio is in jointly coded channels, the tool measures (2040) quality using a technique for jointly coded channels. For example, the tool uses a different band weighting technique depending on the channel mode. Alternatively, the tool uses a different technique for measuring noise, excitation, masking capacity, or other pattern in the audio depending on the channel mode.

While FIG. 20 shows two modes, other numbers of modes are possible. For the sake of simplicity, FIG. 20 does not show repeated computation of the quality measure for the block (as in a quantization loop), or other ways in which the technique (2000) can be used in conjunction with other techniques.

3. Band Truncation

In one implementation, the encoder can truncate higher bands to improve audio quality for the remaining bands. The encoder can adaptively change the threshold above which bands are truncated, truncating more or fewer bands depending on current quality measurements.

When the encoder truncates a band, the encoder does not factor the quality measurement for the truncated band into the NER. With reference to FIG. 14*a*, the array Z[b] indicates which bands are truncated in the block with a weighting pattern such as one described above for the array G[b]. When the encoder measures quality for critical bands, the encoder maps truncated quantization bands to critical bands using a mapping technique such as one described above for the array G[b]. When the encoder measures quality of multi-channel audio in jointly coded channels, the encoder can use the same array Z[b] for all reconstructed channels.

E. Computing Noise to Excitation Ratio

With reference to FIG. 14*a*, the encoder next computes (790) band-weighted NER for the block. For the critical bands of the block, the encoder computes the ratio of the noise pattern F[b] to the effective excitation pattern $\tilde{E}[b]$. The encoder weights the ratio with band weights to determine the band-weighted NER for a block of a channel c:

$$NER[c] = \sum_{all\ b} W[b]\frac{F[b]}{\tilde{E}[b]}. \tag{29}$$

Another equation for NER[c] if the weights W[b] are not normalized is:

$$NER[c] = \frac{\sum_{all\ b} W[b]\frac{F[b]}{\tilde{E}[b]}}{\sum_{all\ b} W[b]}. \tag{30}$$

Instead of a single set of band weights representing one kind of weighting factor or an aggregation of all weighting factors, the encoder can work with multiple sets of band weights. For example, FIG. 14*a* shows three sets of band weights W[b], G[b], and Z[b], and the equation for NER[c] is:

$$NER[c] = \frac{\sum_{\text{all } b \text{ where } G[b]\neq 1 \text{ and } Z[b]\neq 1} W[b]\frac{F[b]}{\tilde{E}[b]}}{\sum_{\text{all } b \text{ where } G[b]\neq 1 \text{ and } Z[b]\neq 1}}. \quad (31)$$

For other formats of the sets of band weights, the equation for band-weighted NER[c] varies accordingly.

For multi-channel audio, the encoder can compute an overall NER from NER[c] of each of the multiple channels. In one implementation, the encoder computes overall NER as the maximum distortion over all channels:

$$NER_{overall} = \underset{All\ c}{\text{MAX}}(NER[c]). \quad (32)$$

Alternatively, the encoder uses another non-linear or linear function to compute overall NER from NER[c] of multiple channels.

F. Computing Noise to Excitation Ratio with Quantization Bands

Instead of measuring audio quality of a block by critical bands, the encoder can measure audio quality of a block by quantization bands, as shown in FIG. 14*d*.

The encoder computes (1410, 1430) the excitation patterns E[b] and $\hat{E}$[b], computes (1450) the effective excitation pattern $\tilde{E}$[b], and computes (1470) the noise pattern F[b] as in FIG. 14*a*.

At some point before computing (791) the band-weighted NER, however, the encoder converts all patterns for critical bands into patterns for quantization bands. For example, the encoder converts (780) the effective excitation pattern $\tilde{E}$[b] for critical bands into an effective excitation pattern $\tilde{E}$[d] for quantization bands. Alternatively, the encoder converts from critical bands to quantization bands at some other point, for example, after computing the excitation patterns. In one implementation, the encoder creates $\tilde{E}$[d] by weighting $\tilde{E}$[b] according to proportion of spectral overlap (i.e., overlap of frequency ranges) of the critical bands and the quantization bands. Alternatively, the encoder uses another linear or non-linear weighting techniques for the band conversion.

The encoder also converts (785) the noise pattern F[b] for critical bands into a noise pattern F[d] for quantization bands using a band weighting technique such as one described above for $\tilde{E}$[d].

Any weight arrays with weights for critical bands (e.g., W[b]) are converted to weight arrays with weights for quantization bands (e.g., W[d]) according to proportion of band spectrum overlap, or some other technique. Certain weight arrays (e.g., G[d], Z[d]) may start in terms of quantization bands, in which case conversion is not required. The weight arrays can vary in terms of amplitudes or number of quantization bands within an encoding session.

The encoder then computes (791) the band-weighted as a summation over the quantization bands, for example using an equation given above for calculating NER for critical bands, but replacing the indices b with d.

Having described and illustrated the principles of our invention with reference to an illustrative embodiment, it will be recognized that the illustrative embodiment can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the illustrative embodiment shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. In a transform-based audio encoder, a method of improved band truncation, the method comprising:

performing a frequency transform on each of multiple input channels of a multi-channel input audio signal to produce multiple input channels of transform domain coefficients;

performing a multi-channel transformation on the multiple input channels of transform domain coefficients for the multi-channel input audio signal to produce a plurality of joint coding channels;

on a channel-by-channel basis, selectively suppressing at least one of the joint coding channels as a function of at least quality of reproduction, rate control buffer fullness, and channel separation, wherein the selectively suppressing comprises scaling the at least one joint coding channel by a scaling factor having a value varying based on a current average level of quality, current rate control buffer fullness and amount of channel separation; and for at least one of the joint coding channels:

selecting as an open-loop process a first portion of the transform domain coefficients for band truncation as a function of a target quality measurement;

suppressing the selected first portion of the transform domain coefficients from encoding in a compressed audio data stream;

measuring an achieved quality measurement of the input audio signal encoded with the selected first portion of the transform domain coefficients suppressed;

selecting as a closed-loop process a second portion of the transform domain coefficients for second band truncation as a function of the achieved quality measurement; and suppressing the selected second portion of the transform domain coefficients from encoding in a second compressed audio data stream.

2. The method of claim 1 wherein the target quality measurement is a target noise-to-excitation ratio for the input audio signal.

3. In a transform-based audio encoder, a method of encoding a multi-channel audio input signal, the method comprising:

performing a frequency transform on each of multiple input channels of the multi-channel audio input signal to produce multiple input channels of frequency coefficient data;

performing a multi-channel transformation on the multiple input channels of frequency coefficient data for the multi-channel audio input signal to produce a plurality of joint coding channels;

on a channel-by-channel basis, selectively suppressing at least one of the joint coding channels as a function of at least quality of reproduction, rate control buffer fullness, and channel separation, wherein the selectively suppressing comprises scaling the at least one joint coding channel by a scaling factor having a value varying based on a current average level of quality, current rate control buffer fullness and amount of channel separation; and encoding the frequency coefficient data for the multi-channel audio input signal with said selective suppression of said at least one joint coding channel.

4. The method of claim 3 further comprising measuring the current average level of quality as a noise-to-excitation ratio for a portion of the multi-channel audio input signal.

5. The method of claim 3 wherein the selectively suppressing the at least one joint coding channel is also a function of a rate setting of the transform-based audio encoder.

* * * * *